US009887074B2

(12) United States Patent
Belov

(10) Patent No.: US 9,887,074 B2
(45) Date of Patent: Feb. 6, 2018

(54) METHOD AND APPARATUS FOR MASS SPECTROMETRY OF MACROMOLECULAR COMPLEXES

(71) Applicant: Thermo Fisher Scientific (Bremen) GmbH, Bremen (DE)

(72) Inventor: Mikhail Belov, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 14/720,159

(22) Filed: May 22, 2015

(65) Prior Publication Data

US 2015/0340213 A1 Nov. 26, 2015

(30) Foreign Application Priority Data

May 23, 2014 (GB) ..... 1409196.1

(51) Int. Cl.
*H01J 49/00* (2006.01)
*H01J 49/40* (2006.01)

(52) U.S. Cl.
CPC ..... *H01J 49/009* (2013.01); *H01J 49/0045* (2013.01); *H01J 49/40* (2013.01)

(58) Field of Classification Search
USPC ..... 250/282
See application file for complete search history.

(56) References Cited

U.S. PATENT DOCUMENTS 5,248,875 A * 9/1993 Douglas ..... H01J 49/005 250/281
6,872,939 B2 * 3/2005 Bateman ..... H01J 49/0081 250/282

(Continued)

FOREIGN PATENT DOCUMENTS

GB 2421843 A 7/2006
GB 2434249 A 7/2007

(Continued)

OTHER PUBLICATIONS

Kaddis; et al, "Sizing Large Proteins and Protein Complexes by Electrospray Ionization Mass Spectrometry and Ion Mobility", J Am Soc Mass Spectrom 2007, 18, pp. 1206-1216.*

(Continued)

*Primary Examiner* — Phillip A Johnston
(74) *Attorney, Agent, or Firm* — David A. Schell

(57) ABSTRACT

A method of analyzing macromolecular complex ions, such protein complex ions, by mass spectrometry and apparatus for performing the method, wherein the method comprises: introducing macromolecular complex ions into a first fragmentation device and trapping the complex ions therein for a trapping period; fragmenting the trapped complex ions in the first fragmentation device to produce monomer subunit ions; optionally selecting one or more species of subunit ions by m/z; introducing one or more of the species of subunit ions into a second fragmentation device, spatially separated from the first fragmentation device; fragmenting the subunit ions in the second fragmentation device to produce a plurality of first fragment ions of the subunit ions; and mass analyzing the first fragment ions in a mass analyzer, or subjecting the first fragment ions to one or more further steps of fragmentation to form further fragment ions and mass analyzing the further fragment ions.

30 Claims, 14 Drawing Sheets

(56) References Cited

U.S. PATENT DOCUMENTS

| | | | | |
|---|---|---|---|---|
| 7,034,292 | B1 | 4/2006 | Whitehouse et al. | |
| 9,048,074 | B2 * | 6/2015 | Senko | H01J 49/0081 |
| 2004/0094709 | A1 | 5/2004 | Bateman | |
| 2008/0315082 | A1 | 12/2008 | Ogata et al. | |
| 2010/0078551 | A1 | 4/2010 | Loboda | |
| 2014/0027629 | A1 | 1/2014 | Makarov et al. | |

FOREIGN PATENT DOCUMENTS

| | | | |
|---|---|---|---|
| GB | 2467223 | A | 7/2010 |
| WO | WO 98/56028 | A1 | 12/1998 |
| WO | 2007010272 | A2 | 1/2007 |

OTHER PUBLICATIONS

Beardsley; et al, "Non-Covalent Protein Tetramers and Pentamers with "n" Charges Yield Monomers with n/4 and n/5 Charges", Anal Chem. Feb. 15, 2009; 81(4): 1347-1356.*

Belov, M.E. et al., "From Protein Complexes to Subunit Backbone Fragments: A Multistage Approach to Native Mass Spectrometry," Anal. Chem., 2013, 85, 11163-11173.

Benesch, Justin L.P., "Collisional activation of protein complexes: picking up the pieces," J. Am. Soc. Mass Spectrom., 2009, 20, 341-348.

Erba, E. B., "Investigating macromolecular complexes using top-down mass spectrometry," Proteomics, 2014, 14, 1259-1270.

Hopper, et al., "Collision induced unfolding of protein ions in the gas phase studied by ion mobility-mass spectrometry: The effect of ligand binding on conformational stability," J Am Soc Mass Spectrom 2009, 20, 1851-1858.

Lamondlab.com, "Collisional Activation Methods," (2013), available online from http://www.lamondlab.com/MSResource/LCMS/MassSpectrometry/collisionalActivationMethods.php.

Ruotolo, et al., "Evidence of macromolecular protein rings in the absence of bulk water," Science, 2005, 310, 1658-1661.

Zhang, et al., "Native Electrospray and Electron-Capture Dissociation FTICR Mass Spectrometry for Top-Down Studies of Protein Assemblies," Anal. Chem., 2011, 83, 5598-5606.

Ma et al., "Surface Induced Dissociation Yields Quaternary Substructure of Refractory Noncovalent Phosphorylase B and Glutamate Dehydrogenase Complexes", J. Am. Soc. Mass Spectrom. 2014 (25), pp. 368-379.

* cited by examiner

◇ GroEL, monomer
△ GroES, hexamer
quadrupole selection of GroEL subunits
Relative Abundance
m/z GroEL-GroES 14:7 MS3 spectrum
GroEL backbone fragments
9C
9D
[GroES+3H]3+
b69[M+2H]+, -3.01 ppm
y39[M+2H]+, -2.37 ppm
[GroES+2H]2+
Relative Abundance
m/z

METHOD AND APPARATUS FOR MASS SPECTROMETRY OF MACROMOLECULAR COMPLEXES

FIELD OF THE INVENTION

The present invention relates to the field of mass spectrometry, especially mass spectrometry of macromolecular complexes, for example native protein complexes. Aspects of the invention relate to $MS^2$ and $MS^3$ analysis of such complexes.

BACKGROUND OF THE INVENTION

Mass spectrometers are widely used to analyze ions on the basis of their mass-to-charge ratio (m/z). Mass spectrometry has become a primary technique for analysis of proteins. More recently mass spectrometry has been applied to the analysis of large protein complexes. The development of electrospray ionization coupled to mass spectrometry has enabled the analysis of large intact protein complexes, even when the latter are held together by weak non-covalent interactions. The study of protein complexes is important in view of their role as a variety of functional modules in biological systems. A new field has thus emerged, termed native protein mass spectrometry, which focuses on analysis of such species at near-physiological conditions (i.e. at approximately neutral pH).

Typically, the large intact complex ions produced at native conditions have a relatively high mass and relatively low charge state and thus high m/z (typically exceeding m/z 5,000, or exceeding m/z 10,000). Hence, for the mass analysis of the large intact complex ions themselves, it has become a typical application for time-of-flight (TOF) mass analyzers due to their ability to access very high m/z, frequently coupled with dedicated quadrupole mass filters (operating at very low frequencies to extend the mass range). However, recently, electrostatic mass analyzers such as an ORBITRAP mass analyzer have also been employed for native protein complexes (US-2014-0027629-A1) with advantages in mass resolution.

However, for a thorough analysis and identification of the monomer structure of protein complexes, tandem or $MS^n$ mass spectrometry needs to be applied. Numerous approaches to dissociation of intact protein complexes have been described in the prior art, including Collision Induced Dissociation (CID), Electron Capture Dissociation (ECD) and Surface Induced Dissociation (SID). Much of the prior art in this area has been summarised and discussed recently in Belov, M. E.; Damoc, E.; Denisov, E.; Compton, P, D,; Makarov, A, A,; Kelleher, N, L. *Anal. Chem.,* 2013, 85, 11163-11173. In that paper it has been shown that some relatively small protein complexes can be successfully dissociated into the constituent monomer subunits, which then, in turn, are preselected and fragmented in a Higher-Energy Collision Dissociation Cell (HCD cell). The approach relies on dissociation of the native protein complexes in a 'fly-through' mode between a source comprising a dual ion funnel interface with injection flatapole, a mass selector and a HCD cell of an ORBITRAP™ mass spectrometer. That approach, however, has been found to be unreliable for some large complexes such as GroEL native complexes and has been found to be inapplicable to large heteromeric complexes (e.g., GroEL-GroES 14:7 complex).

In another prior art approach, the activation of the native protein complexes in the skimmer region of an ion mobility/time-of-flight mass spectrometer (IMS-TOFMS) has been investigated (Ruotolo, B. T.; Giles, K.; Campuzano, I.; Sandercock, A. M.; Bateman, R. H.; Robinson, C. V. Evidence of macromolecular protein rings in the absence of bulk water. *Science,* 2005, 310, 1658-1661; and Benesch, J. L. P. Collisional activation of protein complexes: picking up the pieces. *J. Am. Soc. Mass Spectrom.,* 2009, 20, 341-348). The restructuring and unfolding of the protein complexes of interest was reported as confirmed by IMS measurements. However, no dissociation of native protein complexes (i.e., ejection of the monomer subunits) was observed, probably due to the elevated pressure in the skimmer interface.

It is therefore desirable to provide a more effective method and apparatus for the fragmentation of a wider range of large protein complexes.

In view of the above background, the present invention has been made.

SUMMARY OF THE INVENTION

According to one aspect of the present invention there is provided a method of analyzing macromolecular complex ions by mass spectrometry comprising:

- introducing macromolecular complex ions into a first fragmentation device and trapping the complex ions therein for a trapping period;
- fragmenting the trapped complex ions in the first fragmentation device to produce monomer subunit ions;
- optionally selecting one or more species of subunit ions by m/z;
- introducing one or more species of subunit ions into a second fragmentation device, spatially separated from the first fragmentation device;
- fragmenting the subunit ions in the second fragmentation device to produce first fragment ions of the subunit ions; and
- mass analyzing the first fragment ions in a mass analyzer, or subjecting the first fragment ions to one or more further steps of fragmentation to form further fragment ions and mass analyzing the further fragment ions.

The trapping period is preferably at least 2 ms (milliseconds). In a preferred embodiment, the method may comprise introducing the macromolecular complex ions as a continuous stream into the first fragmentation device, wherein the trapping period is at least 2 ms; the method further comprising:

ejecting the monomer subunit ions as a packet from the first fragmentation device to the second fragmentation device;

repeating the steps of trapping the complex ions in the first fragmentation device and ejecting the packets of subunit ions from the first fragmentation device so as to accumulate a plurality of packets of subunit ions in the second fragmentation device;

fragmenting the accumulated plurality of packets of subunit ions in the second fragmentation device to produce the first fragment ions of the subunit ions; and mass analyzing the first fragment ions in the mass analyzer, or subjecting the first fragment ions to one or more further steps of fragmentation to form further fragment ions and mass analyzing the further fragment ions.

The invention is generally implemented in two spatially separated fragmentation steps, enabling $MS^2$ and $MS^3$ respectively. The first and second fragmentation devices are generally arranged in order of distance from the ion source, i.e. with the first fragmentation device (for $MS^2$) located closest to the ion source and the second fragmentation device (for $MS^3$) located furthest from the ion source.

Preferably the complex ions are trapped or accumulated for fragmentation in the first fragmentation device for a first trapping period under conditions as hereafter described in more detail. Additionally, the produced subunit ions are generally trapped or accumulated for fragmentation in the second fragmentation device, e.g. for a second trapping period, under conditions as hereafter described in more detail.

The complex ions and the subunit ions are generally fragmented by the mechanism of collision induced dissociation (CID). The species of monomer subunit ions may be species of different mass to charge ratio (m/z), the monomer subunits being the monomers of the complex ions. Typically the monomer subunits are monomers of the complex ions that are non-covalently bound in the complex, e.g. the monomer subunits may be protein monomers (proteins) of a protein complex. Preferably, the method comprises selecting one or more species of subunit ions by m/z downstream of the first fragmentation device and upstream of the second fragmentation device, whereby one or more species of subunit ions selected by m/z in this way are received by the second fragmentation device.

In addition to the step of analyzing the fragment ions, the invention may also comprise mass analyzing the subunit ions and/or the complex ions, in which case the subunit ions may be passed to the mass analyzer for analysis without the subunit ions entering the second fragmentation device and/or the complex ions may be passed to the mass analyzer for analysis without being trapped or fragmented in the first fragmentation device.

The one or more further steps of fragmentation may be performed in the first and/or second fragmentation device as will be apparent from the description below.

The invention also provides apparatus for performing the method.

In still another aspect, the invention provides a fragmentation device comprising a stacked ring assembly to receive complex ions generated from an ion source. The fragmentation device comprising a stacked ring assembly to receive ions generated from an ion source may be employed as the first fragmentation device of aspects of the invention.

In yet still another aspect, the invention provides a mass spectrometer for mass analyzing macromolecular complex ions comprising:

an ion source for generating macromolecular complex ions;

a first fragmentation device comprising a stacked ring assembly ion trap for receiving complex ions generated from the ion source and trapping the ions for a trapping period and for at least fragmenting the complex ions to monomer subunit ions;

optionally a mass filter downstream of the first fragmentation device for selection of subunit ions from the first fragmentation device by m/z;

a second fragmentation device spatially separated from the first fragmentation device for receiving subunit ions from the first fragmentation device and configured to fragment the subunit ions; and a mass analyzer to receive and mass analyze ions from the first and/or second fragmentation devices.

In a further aspect, the invention provides a mass spectrometer for mass analyzing macromolecular complex ions comprising:

an ion source for generating macromolecular complex ions;

a first fragmentation device comprising an ion trap for receiving complex ions generated from the ion source, wherein the ion trap is configured to be pumped to a pressure above about $10^{-2}$ mbar (preferably from about $10^{-2}$ mbar to about $10^{-1}$ mbar), to trap the complex ions for a period of at least 2 ms and to provide a collision energy from about 100 to 300 V per elementary charge of the complex ions for at least fragmenting the complex ions to monomer subunit ions;

optionally a mass filter downstream of the first fragmentation device for selection of subunit ions from the first fragmentation device by m/z;

a second fragmentation device spatially separated from the first fragmentation device for receiving subunit ions from the first fragmentation device and configured to fragment the subunit ions; and a mass analyzer to receive and mass analyze ions from the first and/or second fragmentation devices.

The apparatus preferably comprises a mass filter downstream of the first fragmentation device for selection of ions from the first fragmentation device by m/z. The second fragmentation device then is preferably downstream of the mass filter.

In a still further aspect, the invention provides an ion trap fragmentation device for a mass spectrometer, the ion trap comprising two differently pumped sections wherein a higher pressure section is located further from a mass analyzer than a lower pressure section, which may be employed as the second fragmentation device.

In an additional aspect, the invention provides a mass spectrometer comprising:

an ion source;

a fragmentation device; and a mass analyzer to receive and mass analyze ions from the fragmentation device, wherein the fragmentation device is an ion trap comprising two differently pumped sections: a higher pressure section and a lower pressure section, and the higher pressure section comprises a stacked ring assembly.

Optionally, the higher pressure section is located further from the mass analyzer than the lower pressure section.

Preferably, the ion trap comprising two differently pumped sections is employed as the second fragmentation device in other aspects the invention.

In a yet further aspect, the invention provides a mass spectrometer comprising:

an ion source;

a fragmentation device; and a mass analyzer to receive and mass analyze ions from the fragmentation device, wherein the fragmentation device is an ion trap comprising two differently pumped sections wherein a higher pressure section is located further from the mass analyzer than a lower pressure section and ions from the ion source must be passed through the lower pressure section to reach the higher pressure section and must be passed back through the lower pressure section to reach the mass analyzer.

Further features of the invention will now be described, including the preferred embodiments for implementing the invention.

PREFERRED EMBODIMENTS OF THE INVENTION

Preferably, the introduced complex ions are (intact) protein complex ions. Preferably, the complex ions are non-covalently bound protein complexes, preferably in a native state. The introduced complex ions may comprise 2, 3, 4, 5, 6, 7, 8, 9, or 10 or more monomers, e.g. protein monomers.

Advantageously, the complex ions may be decamers (10 monomers) or higher order complexes (e.g. tetradecamers, having 14 monomers). Accordingly, preferably, the monomer subunit ions are protein ions. Furthermore, preferably, the first fragment species are peptide level fragments (i.e. peptide fragments). Whilst the invention is illustrated herein with respect to protein complexes, it should be understood that the invention is not limited to such and may be applied to other macromolecular complex ions. Other macromolecular complexes may include: DNA-protein, RNA-protein, antibody-drug conjugates, protein-ligand complexes etc.

Preferably, the complex ions have a mass-to-charge ratio of least 5,000, more preferably at least 10,000, even more preferably at least 15,000, and up to 30,000, or more. The mass of the complex ions analyzed may be greater than 0.2 MDa, or greater than 0.5 MDa, or greater than 1 MDa or greater than 2 MDa (MDa=MegaDalton). The mass may be up to 2 MDa, or up to 3 MDa, or greater. The mass of the subunit ions may be up 100 kDa (equal to 0.1 MDa), or greater.

The invention preferably comprises steps of producing ions in an ion source and introducing the ions into the mass spectrometer. Preferably, the ions are produced by electrospray (ESI), especially nano ESI, or MALDI, laserspray or inlet ionization, i.e. the ion source is preferably one of: an electrospray (ESI) ion source, especially nano ESI ion source, a MALDI ion source, a laserspray ion source, and an inlet ionization source. The ions are preferably produced by a method of atmospheric pressure ionisation, e.g. such as electrospray ionisation, MALDI etc. The ions thus produced are multiply-charged.

Preferably, the ions are produced from solution, especially electrosprayed from solution. The ions are preferably produced by (preferably electrospray) methods that favour production of ions with a low charge per unit mass (z/m). The ions are more preferably produced (especially electrosprayed) from a solution with a pH greater preferably 5 or higher. Especially preferred is to produce the ions from a solution with a pH in the range 6 to 8.5, more preferably in the range 7.0 to 7.6. Thus, the solution in such embodiments is preferably at near-physiological condition (pH ~7). Thus, the ion source is preferably an electrospray source interfaced to a solution with a pH in the aforesaid ranges, especially in the range 6 to 8.5.

Preferably, an ion funnel arrangement is provided between the ion source and the first fragmentation device, preferably a dual ion funnel arrangement, wherein the ion source is an electrospray ion source, with orthogonal ion injection from the ion source into the ion funnel arrangement. Such an arrangement assists an efficient desolvation of the complex ions.

In certain embodiments the first fragmentation device is an ion trap, and in such embodiments, preferably, the first fragmentation device is a linear ion trap, such as a multipole. The ion trap is preferably configured to provide an axial electric field and an RF electric field. In preferred embodiments, the first fragmentation device comprises a stacked ring assembly, i.e. an RF stacked ring assembly. Further details of the stacked ring assembly are described below.

The first fragmentation device, as a linear ion trap or stacked ring assembly for example, preferably has end electrodes, positioned at its two ends, that allow ions to be trapped in the device and released when required. The first fragmentation device, as a linear ion trap or stacked ring assembly for example, preferably has an entrance gate and an exit gate, in the form of apertures, to which voltages are controllably applied in use (by a controller) to either trap ions therein (during trapping mode) or allow ions to enter or exit the device.

Preferably, the complex ions are trapped (accumulated) in the first fragmentation device for a period of at least 2 ms, more preferably from about 2 to 200 ms, especially from about 2 to 20 ms (milliseconds). Preferably, the complex ions are introduced into the first fragmentation device from a continuous ion stream and are trapped and accumulated in the first fragmentation device for a period of at least 2 ms, more preferably from 2 to 200 ms, especially from 2 to 20 ms, before ejection of subunit ions towards the second fragmentation device. Thus, preferably, the accumulated ions are dissociated into the plurality of subunits before ejection towards the second fragmentation device.

Preferably, the pressure in the first fragmentation device is above about $10^{-2}$ mbar. More preferably, the pressure in the first fragmentation device is from about $10^{-2}$ mbar to about $10^{-1}$ mbar, especially of the order of about $10^{-1}$ mbar. Preferably, the complex ions undergo collisional dissociation in the first fragmentation device at a collision energy from about 100 to 300 V, preferably 200 to 300V, per elementary charge. The first (and second) fragmentation devices are generally filled with a buffer gas as known in the art for collisional dissociation of ions.

Accumulation of ions of large, intact e.g. protein complexes inside the first fragmentation device at such higher kinetic energy ensures imparting sufficient internal energy into the rotational and vibrational modes of the trapped ions. In contrast to the fly-through approach of the prior art, which limits the interaction time between the ions of interest and buffer gas to the time that the ions traverse the collision cell, the trapping capability in the first fragmentation device ensures the required number of collisions to facilitate efficient protein complex restructuring (e.g. unfolding) and dissociation. That is, once the complex or precursor ions are trapped at high energy in the first fragmentation device, they receive a high activation energy per collision and also experience large number of collisions, which are sufficient for the dissociation of larger protein complexes. In addition, kinetic energy modulation is no longer a problem as in the prior art, because, upon dissociation, the fragment ions become collisionally relaxed in the trap, and then ejected under optimum settings for transmission through the downstream ion optics. With the prior art approach, there are believed to be problems related to the amount of energy which can be deposited into the internal degrees of freedom of large protein complexes to exceed the dissociation threshold. Merely increasing pressure in the interface region, whilst increasing the number of collisions, results in the proportional decrease in the activation energy per collision and insufficient energy transfer into the vibrational and rotation modes for complex dissociation. Given the short residence time in this region it is not possible to reliably dissociate larger complexes. Decreasing pressure in the same region results in an increase in energy transfer per collision but brings about modulation of the ions' kinetic energy and incomplete collisional relaxation, which in turn results in ions escaping the energy barrier generated by the RF radial confining field and the consequent loss of signal.

It can be seen from above that a preferred first fragmentation device comprises an ion trap for receiving complex ions generated from the ion source, wherein the ion trap is configured to be pumped to a pressure above $10^{-2}$ mbar (preferably from $10^{-2}$ mbar to $10^{-1}$ mbar, especially of the order of about $10^{-1}$ mbar), to trap the complex ions for a period of at least 2 ms and to provide a collision energy from 100 to 300 V (preferably 200 to 300V) per elementary charge of the complex ions for at least fragmenting the complex ions to a plurality of monomer subunit ions. The ion trap is most preferably a stacked ring assembly.

Preferably, the step of selecting one or more subunit ions (also termed precursor ions with respect to their subsequent fragmentation downstream) by m/z is performed by a mass filter which is located downstream from the first fragmentation device, more preferably located between the spatially separated first and second fragmentation devices. The m/z selected ions are received by the second fragmentation device, e.g. for $MS^3$ fragmentation. The mass filter is preferably a multipole, e.g. quadruple mass filter, but in other embodiments it could be a mass resolving ion trap for example. Accordingly, preferably the spectrometer comprises a mass filter located between the spatially separated first and second fragmentation device, which is preferably a quadruple mass filter with mass resolving RF/DC applied. The quadrupole mass filter is preferably capable of selecting precursor ion species at m/z up to and above 20,000. The mass filter in operation may select a single m/z species or a narrow or broad range of m/z species to be transmitted through the quadrupole. Thus, either a single precursor ion species may be selected and transmitted or multiple precursor ion species may be selected and concurrently transmitted through the quadrupole mass analyzer. In the case of multiple precursor ion selection, the quadrupole mass analyzer preferably operates in an RF-only mode with a superimposed auxiliary RF waveform. The auxiliary waveform is preferably applied as dipolar excitation between a pair of the quadrupole opposite rods. The frequency spectrum of the auxiliary RF waveform is typically composed of a tailored noise with up to ten different notches, corresponding to the frequencies of secular oscillations of precursor ions in the quadrupole mass analyzer. The width of each notch in the frequency spectrum is preferably in the range of about 1 kHz to 5 kHz.

Preferably, the (selected) subunit ions undergo collisional dissociation in the second fragmentation device at a collision energy from about 100 to 200 V per elementary charge (i.e. collisional activation of the subunit ions occurs in the second ion trap at kinetic energies in the range of 100 to 200 V per elementary charge of the subunit ions).

Preferably, the second fragmentation device is an ion trap. Preferably, the pressure in the second fragmentation device or in at least a part of the second fragmentation device is lower than the pressure in the first fragmentation device. Preferably, the pressure in the second fragmentation device is from about $10^{-4}$ mbar to $10^{-1}$ mbar. More preferably, the pressure in at least a part of the second fragmentation device is from $10^{-4}$ mbar to $10^{-3}$ mbar. More preferably, the pressure in at least another part of the second fragmentation device is above about $10^{-2}$ mbar, most preferably from about $10^{-2}$ mbar to $10^{-1}$ mbar.

The second fragmentation device in some embodiments may be located at a dead-end position, i.e. wherein ions enter the second fragmentation device from one end (e.g. a low pressure end) and must leave via the same end (e.g. low pressure end). A dc-axial field may be provided in the second fragmentation device for this purpose.

In certain embodiments, the second fragmentation device may be a linear ion trap or collision cell. The second fragmentation device may be a high pressure collision dissociation (HCD) cell, preferably located upstream of the mass analyzer, the HCD cell being downstream of the first fragmentation ion trap.

In more preferred embodiments, the second fragmentation device is an ion trap configured as two separate sections. For this configuration, the second fragmentation device is preferably separated into differently pumped pressure regions, comprising a higher pressure region (preferably above $10^{-2}$ mbar, more preferably at $10^{-2}$ to $10^{-1}$ mbar) and a lower pressure region (preferably at $10^{-4}$ to $10^{-3}$ mbar).

Preferably, the higher pressure region of the second fragmentation device comprises a stacked ring assembly. Preferably, the lower pressure region of the second fragmentation device comprises a multipole.

The second fragmentation device, as a linear ion trap or stacked ring assembly for example, preferably has end or gate electrodes, positioned at its two ends, which allow ions to be trapped in the device and released when required.

Preferably, the mass analyzer is a high mass resolution analyzer, and preferably also is a high mass accuracy analyzer. The mass analyzer is preferably an electrostatic trap or time of flight (TOF) or quadrupole mass analyzer or FT-ICR mass analyzer. The electrostatic trap is most preferably an orbital trap mass analyzer, such as an ORBITRAP mass analyzer. The spectrometer may in some embodiments comprise more than one mass analyzer, e.g. it may comprise one of the aforesaid high resolution mass analyzers and another mass analyzer such as a linear ion trap mass analyzer.

Subsequent to mass analysis, the method preferably further comprises identifying the monomer subunits (e.g. proteins) of the complex ions from the mass analysis of the fragment ions, i.e. by determination of the peptide sequence.

In the preferred embodiments wherein the first fragmentation device comprises a stacked ring assembly (i.e. RF stacked ring assembly), the stacked ring assembly preferably is configured to provide an axial electric field. The stacked ring assembly is also preferably configured to provide an RF electric field, e.g. by the application of RF waveforms to the electrodes of the stacked ring assembly.

Preferably, the stacked ring assembly of the first fragmentation device comprises a plurality of ring electrodes wherein adjacent electrodes are resistively coupled to each other. A DC voltage may be applied across the plurality of electrodes thereby to provide an axial electric field. Moreover, an RF power supply is provided for applying two RF voltage waveforms to the plurality of electrodes such that one of the RF waveforms is applied to every other electrode and the other RF waveform is applied to the remaining electrodes, the two RF voltage waveforms being 180 degrees out of phase with each other. In this way, adjacent electrodes have opposite polarities. The stacked ring assembly preferably comprises at least four independently controlled electrodes. Most preferably, the stacked ring assembly comprises four electrodes.

Preferably, the electrodes of the stacked ring assembly are capacitively coupled to the RF waveforms. Preferably, the RF waveforms have an RF amplitude of 100 $V_{pp}$ to 300 $V_{pp}$. Preferably, the RF waveforms have an RF frequency of about 2 MHz.

Preferably, the pressure in the stacked ring assembly of the first fragmentation device in operation is at least about $10^{-2}$ mbar, especially from about $10^{-2}$ mbar to $10^{-1}$ mbar. Preferably, the stacked ring assembly of the first fragmentation device is configured (i.e. has voltages applied to its electrodes by a controller) to provide a collision energy for ions therein of about 100 to 300 V, preferably 200 to 300V, per elementary charge.

The use of a stacked ring assembly increases the charge capacity of the first fragmentation device and enables the use of RF waveforms at considerably lower amplitudes than that employed with a linear trap (e.g., a flatapole). The former factor is important for obtaining higher signal-to-noise ratios, for example of fragments ions in $MS^3$ spectra derived from large protein complexes. The latter factor may mitigate the onset of a corona discharge characteristic of high voltage applications in transitional pressure regimes ($10^{-1}$ mbar× cm). The stacked ring assembly may also assist the efficient desolvation of the complex ions.

In the fragmentation device, preferably the second fragmentation device, that is an ion trap comprising two differently pumped sections, preferably a higher pressure section is located further from the mass analyzer than a lower pressure section, and preferably a lower pressure section is located closer to the first fragmentation device than the higher pressure section, such that ions generally must first pass (initially via an entrance of the lower pressure section) through the lower pressure section to reach the higher pressure section and subsequently must pass again through the lower pressure section (finally leaving via the entrance of the lower pressure section) to reach the mass analyzer.

Preferably, such device has a higher pressure section configured to be pumped to a pressure above about $10^{-2}$ mbar. Preferably, the higher pressure section of the fragmentation device is configured to be pumped to a pressure of about $10^{-2}$ mbar to $10^{-1}$ mbar in operation. Preferably, the lower pressure section of the second fragmentation device is configured to be pumped to a pressure of $10^{-4}$ mbar to $10^{-3}$ mbar in operation.

Preferably, the higher pressure section of the second fragmentation device comprises a stacked ring assembly. The stacked ring assembly of the higher pressure section preferably provides an axial DC electric field and preferably comprises a plurality of ring electrodes wherein adjacent electrodes are resistively coupled to each other. A DC voltage may be applied across the plurality of electrodes thereby to provide an axial electric field. Moreover, an RF power supply is provided for applying two RF voltage waveforms to the plurality of electrodes, such that one of the RF waveforms is applied to every other electrode and the other RF waveform is applied to the remaining electrodes, the two RF voltage waveforms being 180 degrees out of phase with each other. In this way, adjacent electrodes have opposite polarities. The stacked ring assembly of the higher pressure section preferably comprises four or at least four independently controlled electrodes. Preferably, the electrodes are capacitively coupled to the RF waveforms. Preferably, the RF waveforms have an RF amplitude of 100 $V_{pp}$ to 200 $V_{pp}$. Preferably, the RF waveforms have an RF frequency of about 2 MHz.

Preferably, the second fragmentation device is configured (by voltages applied to its electrodes) to provide a collision energy for ions therein of about 100 to 200 V per elementary charge. Thus, preferably, the stacked ring assembly of the higher pressure section is configured (by voltages applied to its electrodes) to provide a collision energy for ions therein of 100 to 200 V per elementary charge in the laboratory frame of reference.

Preferably, the lower pressure section of the second fragmentation device comprises an RF multipole, preferably with an axial dc-electric field. The axial field allows compression of ions (i.e. fragment ions) as packets adjacent to the multipole entrance prior to consequent ion transfer to the mass analyzer. A controllable voltage may be applied to an entrance gate or aperture of the multipole to enable the compressed ions adjacent the entrance to be released from the multipole for transfer to the mass analyzer. The second fragmentation device is thus preferably configured to allow subunit ions to be fragmented in the higher pressure section and to subsequently accumulate the fragment ions near the entrance of the lower pressure section prior to transferring the fragment ions to the mass analyzer.

Preferably, the stacked ring assembly of the higher pressure section is configured to be pumped to a pressure above about $10^{-2}$ mbar, more preferably to a pressure of about $10^{-2}$ mbar to $10^{-1}$ mbar in operation. The lower pressure section of the fragmentation device, e.g. multipole section preferably is configured to be pumped to a pressure of $10^{-4}$ mbar to $10^{-3}$ mbar in operation.

The use of the preferred arrangement of differently pumped sections of the fragmentation device composed of a stacked ring assembly and an RF multipole with an axial electric field enhances i) high efficiency trapping and fragmentation of ions in the stacked ring assembly, ii) efficient compression of ion packets by the multipole entrance and consequent high-efficiency ion transfer to a high resolution mass analyzer, and iii) lower pressure in the mass analyzer, which is critically important for obtaining high mass accuracy and resolution. In addition, the high pressure section is also efficient for intact proteins, as intact protein complexes may be trapped and collisionally relaxed in the higher pressure section and then injected into the mass analyzer such as an ORBITRAP mass analyzer for high resolution detection at lower pressure.

Preferably, the invention further comprises, trapping (i.e. storing) the ions in an injection ion trap, which is for example a linear ion trap, prior to introducing the ions into the (high resolution) mass analyzer, which in turn is preferably an electrostatic trap but may be a TOF or FT-ICR. The injection ion trap is preferably a multipole ion trap, such as a multipole linear ion trap, especially a curved linear ion trap (C-trap) in the case of injection into an orbital trap such as an ORBITRAP mass analyzer. The ions are preferably introduced directly from this injection ion trap to the mass analyzer, especially introduced as a pulse of ions from the injection ion trap to the mass analyzer. The injection ion trap may receive ions from the second fragmentation ion trap and/or from the first fragmentation ion trap, preferably from both. In a preferred embodiment, the injection ion trap is located between the first and second fragmentation cells, also preferably downstream of the mass filter.

The mass analyzer in general is not limited to any specific type, but is generally a mass analyzer capable of high mass resolving power and high mass accuracy and for example may be an electrostatic trap, such as an orbital trap (e.g. an ORBITRAP™ mass analyzer), or an FT-ICR mass analyzer, or a TOF mass analyzer. The method comprises introducing the ions to be analysed into the mass analyzer and detecting the ions in the mass analyzer. The mass analyzer is preferably for receiving and trapping ions therein and for causing the ions to undergo periodic motion, e.g. to oscillate (which term herein also encompasses motion that is rotational) within the mass analyzer. Preferably, the oscillation of the ions in the mass analyzer is detected by image current detection. Such detection is preferably provided by an electrostatic trap mass analyzer, such as an orbital trap. Preferably, the pressure in the mass analyzer is not greater than $1\times10^{-8}$ mbar, preferably not greater than $5\times10^{-9}$ mbar, more preferably not greater than $2\times10^{-9}$ mbar and even more preferably not greater than $1\times10^{-9}$ mbar.

A controller for the mass spectrometer preferably comprises a computer that is programmed for example to control the introduction of ions in the described manner, including the described steps of trapping and fragmentation of ions, applying the necessary voltages to the electrodes of the ion traps (stacked ring assemblies) and controlling the vacuum pumping to attain the specified pressures. A signal processing system also preferably comprises a computer that is programmed to determine the mass-to-charge ratio of at least some ions detected in the mass analyzer and produce a mass spectrum. The controller and the signal processing system may comprise the same computer, or different computers.

The present invention, in embodiments, provides a multi-stage fragmentation approach (enabling $MS^3$, $MS^n$) for dissociation of native protein complexes. The approach comprises firstly trapping the complexes for a period, especially in a stacked ring assembly, to enable efficient collision induced dissociation of the protein complexes ($MS^2$) under conditions of high pressure and high collision energy into the constituent monomer subunits (protein monomers), preferably followed by selection of monomer subunits by their mass-to-charge (m/z) ratios (e.g., with a quadrupole mass filter), and subsequently dissociating (especially collision induced dissociation) the monomer subunits into monomer fragments, especially using a dual-pressure section ion trap ($MS^3$). The monomer fragment ions are then analysed at high mass resolution and mass measurement accuracy, thereby enabling reliable identification of the monomer subunits (proteoforms) and consequently determine the stoichiometry and composition of the intact protein complex. If required, the first fragments (peptide level fragments) produced in the second fragmentation device can be subjected to one or more further stages of fragmentation ($MS^4$ or more generally $MS^n$) in either the second fragmentation device, or by passing the ions back upstream to the first fragmentation device. Thus, the combination of first and second fragmentation devices of the invention may also be used for $MS^n$ experiments, so that ions can be passed back and forth between the traps, enabling selection and fragmentation on each trapping event. The present invention does not exclude the possibility of providing in the mass spectrometer a third fragmentation device etc., which could be utilised for a further stage of fragmentation.

DESCRIPTION OF THE DRAWINGS

FIG. 5B) shows a pseudo $MS^2$ spectrum; FIG. 5C) shows a mass spectrum of the GroEL subunits after both activation in the front-end trap and quadrupole selection at m/z window of 1000 Th; and FIG. 5D) shows a mass spectrum of a single charge state of a GroEL subunit obtained by dissociation of the GroEL complex in the front-end trap and subsequent selection by the quadrupole mass filter.

FIGS. 6A-6C show $MS^3$ spectra obtained using the invention for a 14-mer GroEL complex, wherein FIG. 6A shows a complete $MS^3$ spectrum after isolation of 3 most abundant charge states of the GroEL monomer; FIG. 6B shows a portion of the mass spectrum in FIG. 6A with selected peptide identifications; and FIG. 6C shows one of the peptide identifications from the spectrum FIG. 6B.

FIG. 7A shows a mass spectrum of an intact GroEL-GroES 14:7 complex; spectrum FIG. 7B shows a pseudo $MS^2$ spectrum with charge states of GroES monomer indicated; and spectrum FIG. 7C shows an expanded view of the spectrum FIG. 7B showing peaks of various charge states of GroEL monomer, GroES monomer and GroES hexamer.

FIGS. 8A-8B show further spectra obtained using the invention for GroEL-GroES 14:7 complex, wherein FIG. 8A shows the $MS^2$ spectrum from a GroEL-GroES 14:7 complex with selection of the $[GroES+5H]^{5+}$ monomer by the quadrupole mass filter; and FIG. 8B shows the $MS^3$ spectrum of fragments from the $[GroES+5H]^{5+}$ precursor.

FIGS. 9A-9D show still further spectra obtained using the invention for GroEL-GroES 14:7 complex, wherein FIG. 9A shows selection of GroEL monomer subunits using the quadrupole; and FIG. 9B shows the $MS^3$ spectrum, with the GroEL backbone fragments indicated (section expanded in FIG. 9C), along with GroES monomers (section expanded in FIG. 9D) and fragments.

DETAILED DESCRIPTION OF THE INVENTION

In order to enable a more detailed understanding of the invention, numerous embodiments will now be described by way of example and with reference to the accompanying drawings.

Figure 1:
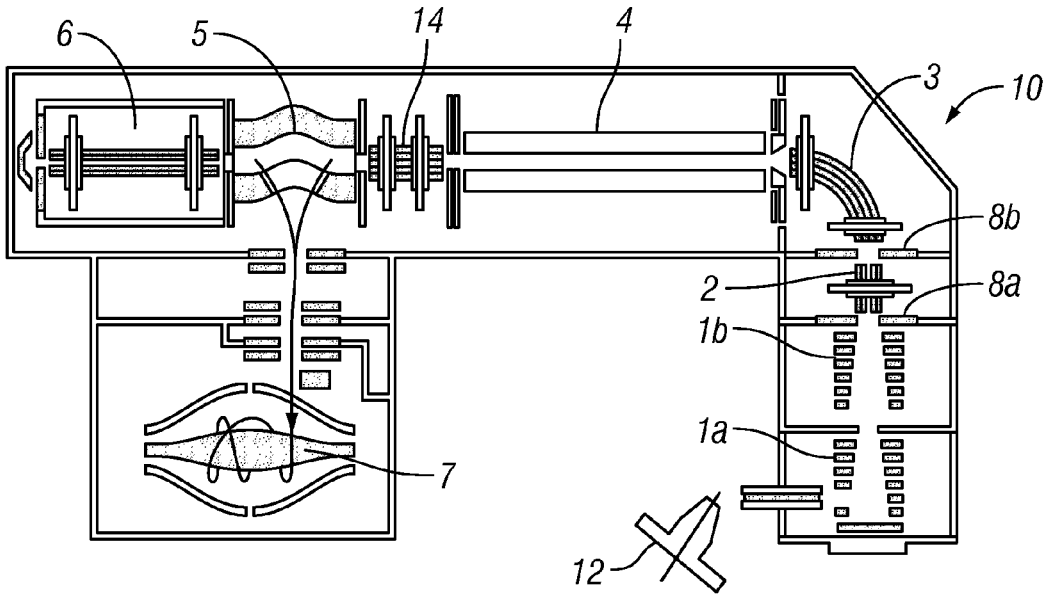
FIG. 1 shows schematically a mass spectrometer according to an embodiment of the present invention.

Referring to FIG. 1, there is shown schematically a mass spectrometer in accordance with an embodiment of the present invention. Three sequential events in sequencing large protein complexes are: i) $MS^2$, i.e. protein complex dissociation to the monomer subunits, ii) $MS^3$, i.e. m/z-based selection and the following fragmentation of the monomer subunits to peptide-level fragments, iii) transfer of the fragment ions to high resolution mass analyzer. These events will be described with reference to the mass spectrometer.

A mass spectrometer 10 generally comprises two ion traps or collision cells 2 and 6 separated by a quadrupole mass filter 4. An ion introduction system comprises an electrospray ion (ESI) source 12 (e.g. nano ESI source) which introduces ions orthogonally into a dual ion funnel arrangement comprising ion funnels 1*a* and 1*b*. Such orthogonal ion injection systems is described in Belov, M. E.; Damoc, E.; Denisov, E.; Compton, P, D,; Makarov, A, A,; Kelleher, N, L. *Anal. Chem.,* 2013, 85, 11163-11173. In use, complex ions such as ions of intact, native-state protein complexes, are thereby electrosprayed into the ion funnels. The pressure in the ion funnel region is typically above 1 mbar (such as 1-20 mbar), e.g. 2 mbar. The ions undergo at least a partial desolvation in the ion funnels.

Figure 2:
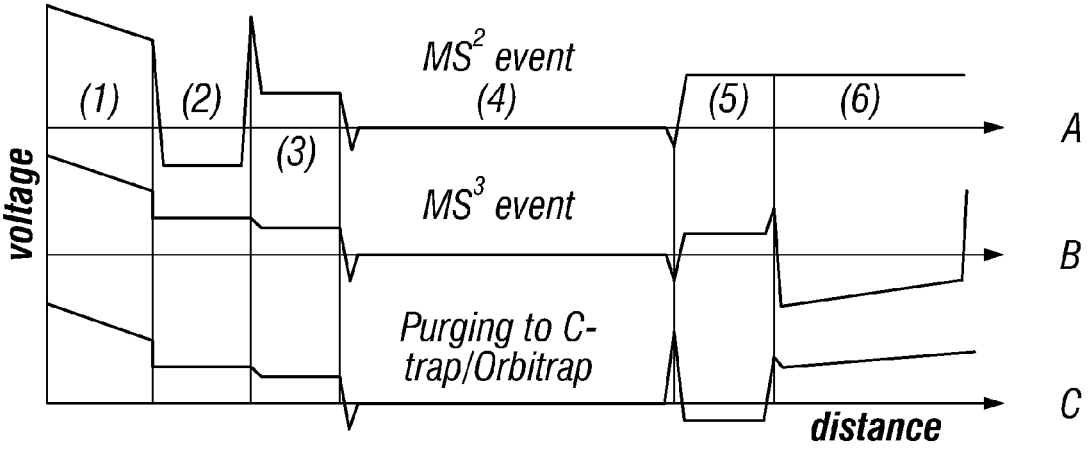
FIG. 2 shows schematically the potentials of parts of the mass spectrometer of FIG. 1, for an $MS^2$ event (A), for an $MS^3$ event (B) and for purging ions to the c-trap (C) before the mass analyzer.

In FIG. 2 is shown schematically the potential voltage in the mass spectrometer at different stages. In FIG. 2(A) is shown the potential during a first stage (i.e. first stage dissociation/$MS^2$). The potential gradient in region (1) represents the axial field in the region of the ion funnels 1*a*, 1*b*. The complex ions are then passed, by axial potentials, to the ion trap 2.

The ion trap 2, which may be referred to as the 'front-end' trap, is the first fragmentation device of the spectrometer. In the embodiment shown, the ion trap 2 is a quadrupole and more specifically is a flatapole. The ion trap 2 has an entrance gate 8*a* and an exit gate 8*b* in the form of apertures. In one mode of operation, the complex ions are introduced as a continuous stream into the ion trap for a period of time while the entrance gate 8*a* has a lowered potential. The exit gate 8*b* has a raised potential to trap the ions in the ion trap. The complex ions are accumulated from the ion stream for a period and then the entrance gate potential is raised to trap the ions in the ion trap. The total trapping time or residence time in the ion trap is at least 2 ms and preferably is from 2 to 200 ms, especially 2 to 20 ms. FIG. 2(A) shows the potential well in the region (2) corresponding to the region in the ion trap 2 during a trapping period. The potential well (2) is bounded by the potential barriers provided by the entrance and exit gates 8*a*, 8*b*.

The ion trap 2 is filled with a buffer gas for collisional dissociation of the complex ions and the pressure in the ion trap 2 is above $10^{-2}$ mbar and preferably is $10^{-2}$ mbar to $10^{-1}$ mbar. In a preferred embodiment, the pressure in the ion trap 2 is $10^{-1}$ mbar. The collisional dissociation is performed with kinetic energies typically in the range of 100 to 300 V per elementary charge in the laboratory frame of reference, preferably 200 to 300V. Such collision energy is derived from the difference between the potential at the trap entrance gate and the flatapole rods. For example, a potential of 100 V can be applied at the trap entrance and −200 V at the inject flatapole rods for this purpose. The residence time of the ions and the pressure in the ion trap 2, together with the high collision energy, are effective for causing dissociation of even large protein complexes into their monomer subunits (proteins). The dissociated ions comprising the subunit (protein) ions are then released from the ion trap by raising the potential of the ion trap 2 and lowering the potential on the exit gate 8*b* as shown in FIG. 2(B).

The front-end ion trap 2 is located upstream of a m/z selection device 4, which in the embodiment is a quadrupole mass filter. The m/z selection device 4 is capable of selecting precursor ion species at m/z over 20,000. Following the dissociation event in the ion trap, the ejected ions of the monomer subunits of the large complex are guided by a bent multipole ion guide 3 (a flatapole) held at a pressure of $10^{-3}$ mbar to the m/z selection device 4 where they can be selected by their m/z and then introduced into another linear ion trap 6 downstream of the m/z selection device. The pressure in the m/z selection device 4 is $10^{-6}$ mbar. The ions are guided downstream of the m/z selection device 4 by a transmission multipole 14 and curved linear ion trap 5 (pressure $\mathbf{10}^{-5}$ mbar) to enter the other linear ion trap 6. The potentials in the regions of the bent flatapole (3), m/z selection device (4) and curved linear ion trap or c-trap (5) as ions are m/z selected and transmitted to the other ion trap 6 for the second dissociation event ($MS^3$) are shown in FIG. 2(B).

The ion trap 6, which may be referred to as the tack-end' trap, is the second fragmentation device of the spectrometer. The trapping potential in the region (6) of the ion trap 6 is shown in FIG. 2(B). The ion trap 6 in this embodiment is a higher energy collision dissociation (HCD) cell, which is generally operated at pressures in the range of $10^{-1}$-$10^{-4}$ mbar and at $10^{-3}$ mbar in the embodiment shown. In the ion trap 6, the ions of monomer subunits of the larger protein complex undergo higher energy collisions. The monomer subunits or protein ions will be activated in the ion trap at collision energies of 100-200 V per elementary charge in the laboratory frame of reference and will then efficiently fragment to the constituent peptide-level fragments. The trapping time in the ion trap 6 is typically 10 to 200 ms for protein complexes.

The peptide-level fragments are subsequently transferred from the ion trap 6 to the c-trap 5 and from there to the mass analyzer, which in the embodiment shown is an ORBITRAP mass analyzer 7. In FIG. 2(C) it is shown that the potential in the ion trap 6 is raised to transfer the ions out of the trap, initially to trap the ions in the c-trap 5 before transferring the ions from the c-trap into the ORBITRAP mass analyzer 7. High resolution mass analysis in the ORBITRAP mass analyzer yields m/z information about the peptide fragments, which in turn enables identification of the monomer subunits.

In a preferred implementation of the invention, complex ions from a continuous ion stream are accumulated and dissociated in the front-end ion trap 2 for fixed periods of 2 to 20 ms and then ejected in a packet after each accumulation period, such that multiple packets are transferred from the front-end ion trap per single accumulation event in the back-end trap 6. For the entire accumulation period in the back-end trap, the mass selection device will be tuned to select precursor ions (monomer subunit or protein ions) of interest by their m/z.

In another preferred embodiment of the invention, the front-end ion trap 2, rather than comprising the flatapole described above, instead comprises a stacked-ring assembly, for example with four independently controlled electrodes. Each two adjacent electrodes of the stacked-ring assembly are resistively coupled to each other, e.g. using a 100 kOhm resistor, to provide an axial electric field across the assembly. Two radiofrequency (RF) waveforms are employed to radially confine ions of both the protein complexes and ejected subunits. Every other electrode of the assembly is coupled to the corresponding RF waveform, preferably capacitively coupled using e.g. a 10 nF capacitor. The RF waveforms are operated at an RF amplitude of 100 $V_{pp}$ to 300 $V_{pp}$ and an RF frequency of 2 MHz, and are phase-shifted by 180 degrees. Collisional activation is performed in the stacked ring assembly at kinetic energies in the range of 100 to 300 V per elementary charge in the laboratory frame of reference as the ions are trapped in the stacked ring assembly for at least 2 ms, more preferably from 2 to 200 ms, and most preferably 2 to 20 ms.

In another preferred embodiment of the invention, the back-end trap 6 is separated into differently pumped pressure regions, referred to herein as higher ($10^{-1}$-$10^{-2}$ mbar) and lower ($10^{-3}$-$10^{-4}$ mbar) pressure sections. The higher pressure section of the back-end trap is constructed as a stacked-ring assembly, similar in construction to that stacked-ring assembly described above. Thus, the stacked-ring assembly is energized with two 180° phase-shifted RF waveforms and the electrodes of the stacked-ring assembly are alternatively coupled to the corresponding RF waveform using e.g. 10 nF capacitors. The RF waveforms are operated at an RF amplitude of 100 $V_{pp}$ to 200 $V_{pp}$ and a frequency of 2 MHz. Adjacent electrodes are DC-coupled, e.g. using 100 kOhm resistors, to provide an axial electric field across the device. In this embodiment having differently pumped pressure regions, the lower pressure section of the back-end trap 6 comprises an RF-only multipole with an axial DC-electric field. Following m/z selection in the quadrupole mass filter 4, the monomer subunit ions are directed to the higher pressure section of the back-end trap for trapping and fragmentation. Following fragmentation and collisional relaxation in the higher pressure section, the peptide-level fragments are transported to the lower pressure region of the back-end trap for accumulation and bunching by the entrance electrode of the trap. Once an ion cloud is tightly compressed in the lower pressure region of the back-end trap, the fragment ion species are then be transferred to the mass analyzer 7 (via the c-trap 5) for high mass accuracy and high resolution detection.

Figure 3:
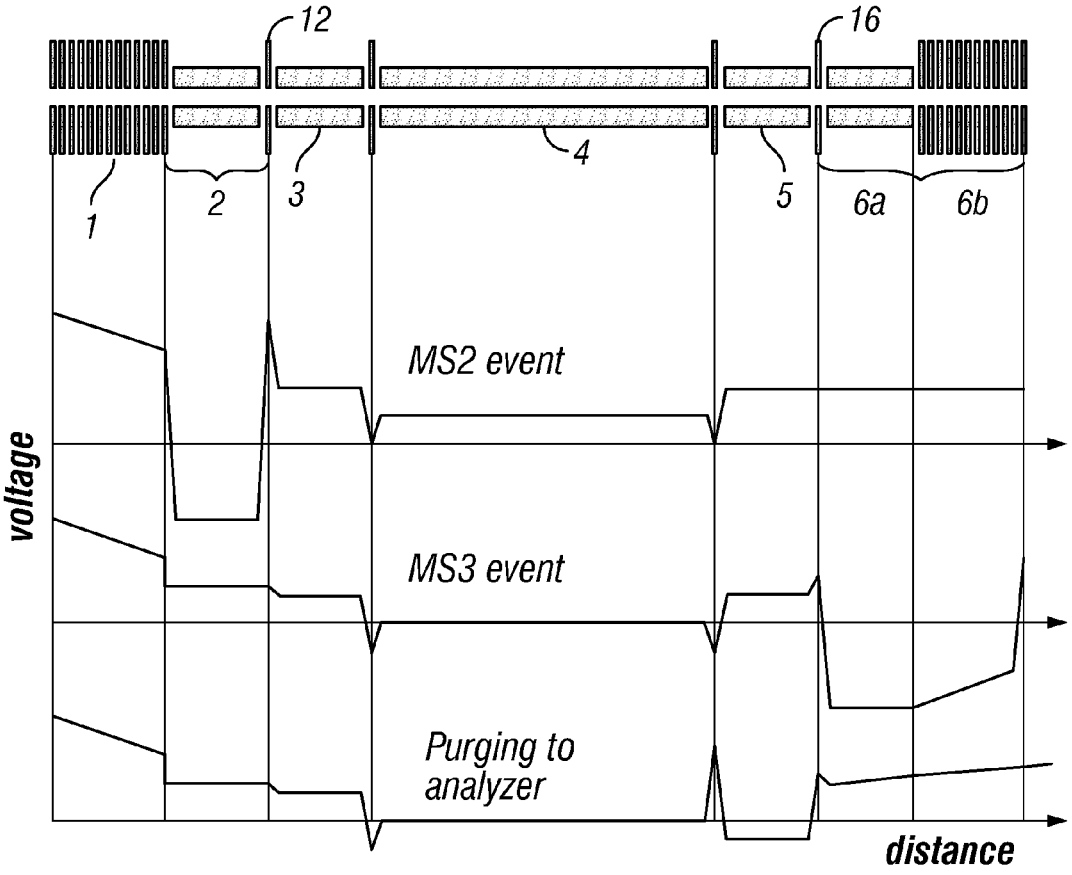
FIG. 3 shows schematically part of a mass spectrometer according to another embodiment of the present invention comprising stacked ring assemblies.

Such an embodiment employing a back-end trap 6 separated into differently pumped pressure regions is shown schematically in FIG. 3, along with potential profiles analogous to FIG. 2. The electrospray source and ORBITRAP mass analyzer are omitted from the figure for simplicity and the figure is intended merely to show the layout of the components relevant for the trapping and fragmentation of the ions. The ion funnel ion guide 1 (at 2 mbar pressure) through which the complex ions enter the system is interfaced to the front-end trap 2 held at $10^{-1}$ mbar. The front-end trap 2 is preferably embodied by the stacked-ring assembly as described above. Upon dissociation of the complex ions in the front-end trap 2, the ejected subunit ions from the front-end trap 2 are transmitted through the transfer multipole 3 (at $10^{-3}$ mbar), the m/z selection device 4 (at $10^{-6}$ mbar) and the multipole (c-trap) 5 (at $10^{-5}$ mbar) finally to enter the back end trap 6. The back end trap 6 comprises a lower pressure section 6*a* (at $10^{-3}$ mbar) and a higher pressure section 6*b* (at $10^{-1}$ mbar). The higher pressure section 6*b* of the back-end trap is constructed as a stacked-ring assembly, as described above. The lower pressure section 6*a* of the back-end trap comprises an RF multipole with an axial DC-electric field. Upon m/z selection in the m/z selection device 4, the monomer subunit ions are directed to the higher pressure section 6*b* of the back-end trap for trapping and fragmentation. Following fragmentation and collisional relaxation, the peptide-level fragments will be transported to the lower pressure region 6*a* of the back-end trap for accumulation and bunching by the entrance electrode 16 of the lower pressure section (by the axial dc-electric field of the RF multipole). Once the ions are tightly compressed in the lower pressure region 6*a* of the back-end trap, the fragment ion species will then be transferred to the mass analyzer.

Figure 4:
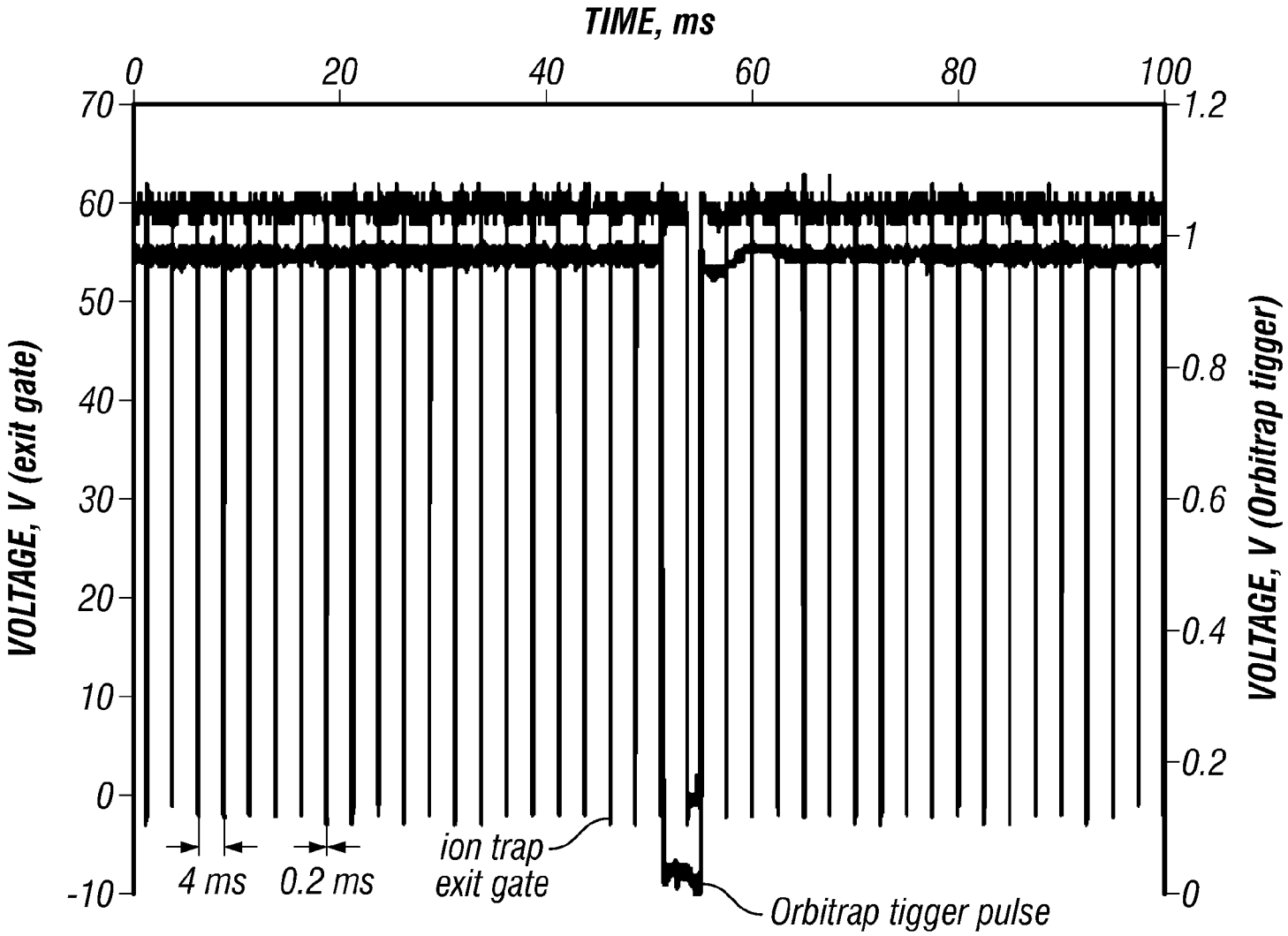
FIG. 4 shows two experimental waveforms as applied to the exit gate of the front-end trap and the mass analyzer trigger respectively in an embodiment of the present invention.

Typically, multiple trapping and ejection events will be conducted in the front-end ion trap 2 for each accumulation in the back-end trap 6 and subsequent mass analysis. Referring to FIG. 4, there are shown two experimental waveforms as applied to the exit gate 8*b* of the front-end trap 2 and the mass analyzer (ORBITRAP mass analyzer) trigger for the embodiment of the invention shown in FIG. 1. During a trapping event of 4 ms duration in the front-end trap 2, the exit gate 8*b* is maintained at 20 to 100 V potential (reference to the earth ground) to ensure blocking of the continuous ion beam from the nano ESI source. The rods of the front-end trap are maintained at potentials of −100 to −200 V. During the ion purging event, ions are released from the front-end trap in narrow 200 μs (i.e. 0.2 ms) wide packets. Purging events correspond to the lower potential of the exit gate waveform. Concurrently with lowering the exit gate potential, the potential at the front-end trap rods (i.e. the bias potential) is increased to the optimum transmission voltage (typically +4 to +7 V). The ORBITRAP mass analyzer trigger pulse is shown superimposed on the pulses for the exit gate.

Figure 5A:
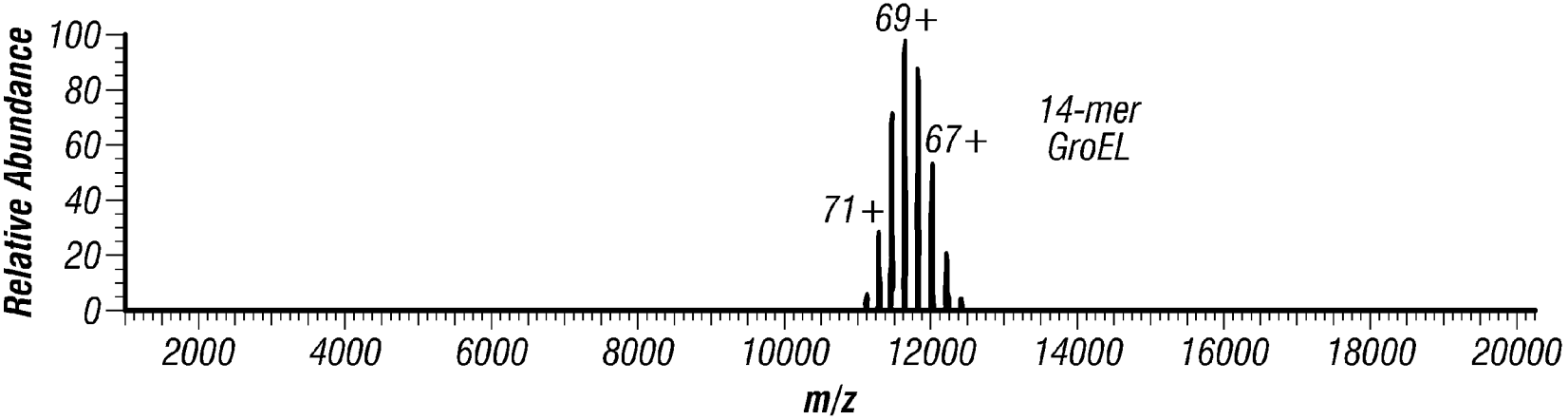
FIGS. 5A-5D show experimental mass spectra recorded using an embodiment of the present invention of a 14-mer protein complex of GroEL, wherein FIG. 5A) shows a mass spectrum of the intact 14-mer complex.
Figure 5B:
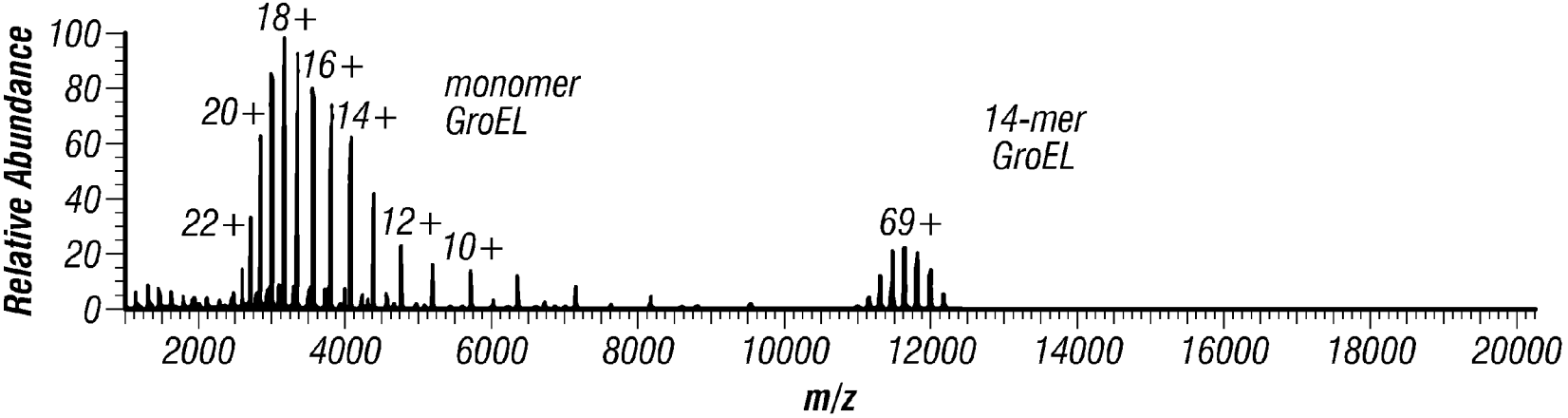
Figure 5C:
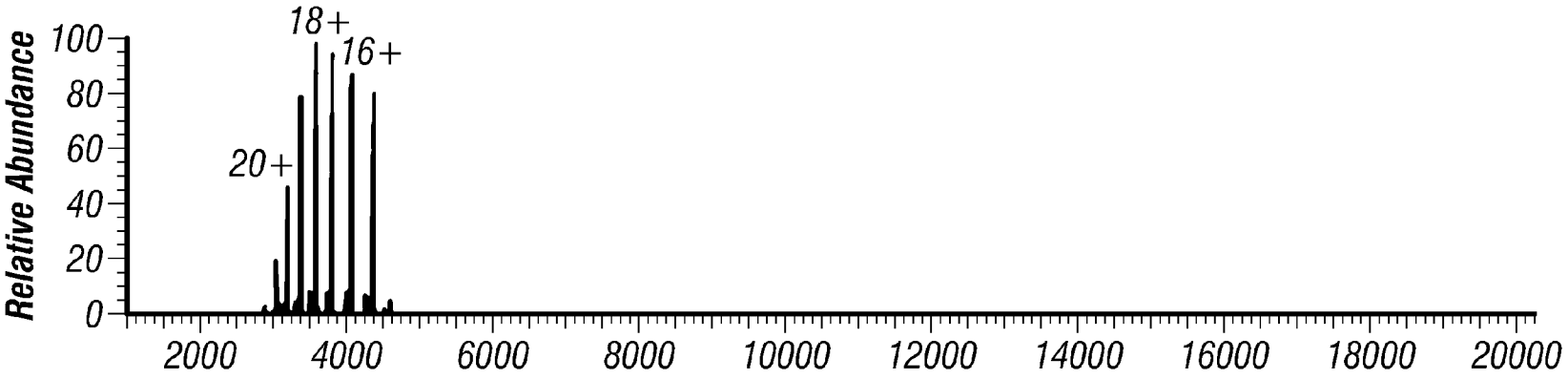
Figure 5D:
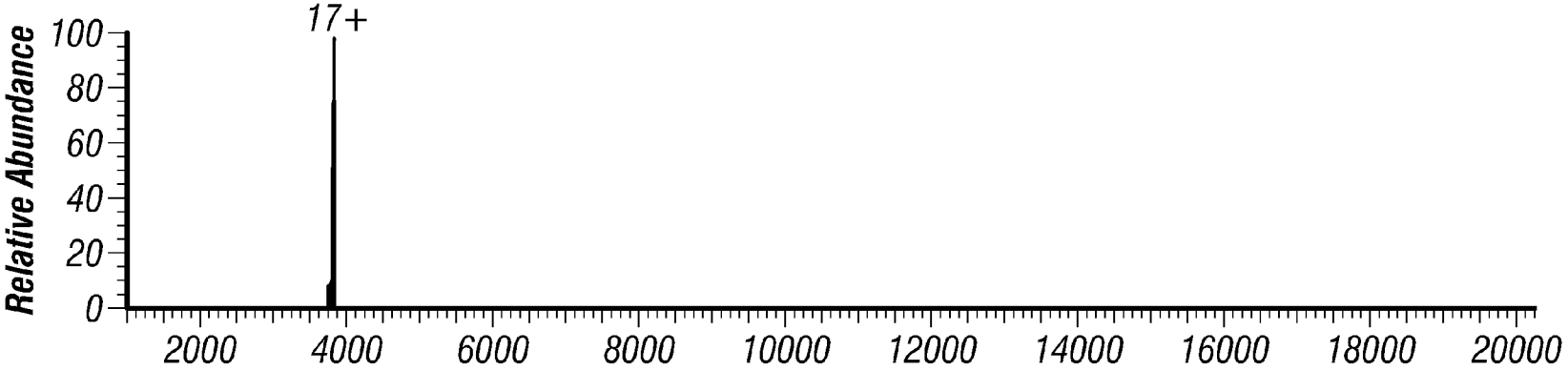

The invention has been found to be effective for obtaining structure and sequence information from large intact protein complexes with high mass resolution and good signal to noise ratio, S/N. Referring to FIGS. 5A-5D, there is shown experimental mass spectra recorded using the present invention of a 14-mer protein complex of GroEL ($MW_{14mer}$: 800,760.7 Da; $MW_{monomer}$: 57,197.19 Da) electrosprayed from ammonium acetate buffer using a nano ESI source. FIG. 5A shows a mass spectrum of the intact 14-mer complex; FIG. 5B shows a pseudo $MS^2$ spectrum, revealing dissociation of the 14-mer GroEL complex into the monomer subunits; FIG. 5C shows a mass spectrum of the GroEL subunits after both activation in the front-end trap and quadrupole selection at m/z window of 1000 Th; and FIG. 5D shows a mass spectrum of a single charge state of a GroEL subunit obtained by dissociation of the GroEL complex in the front-end trap and subsequent selection by the quadrupole mass filter.

Figure 6A:
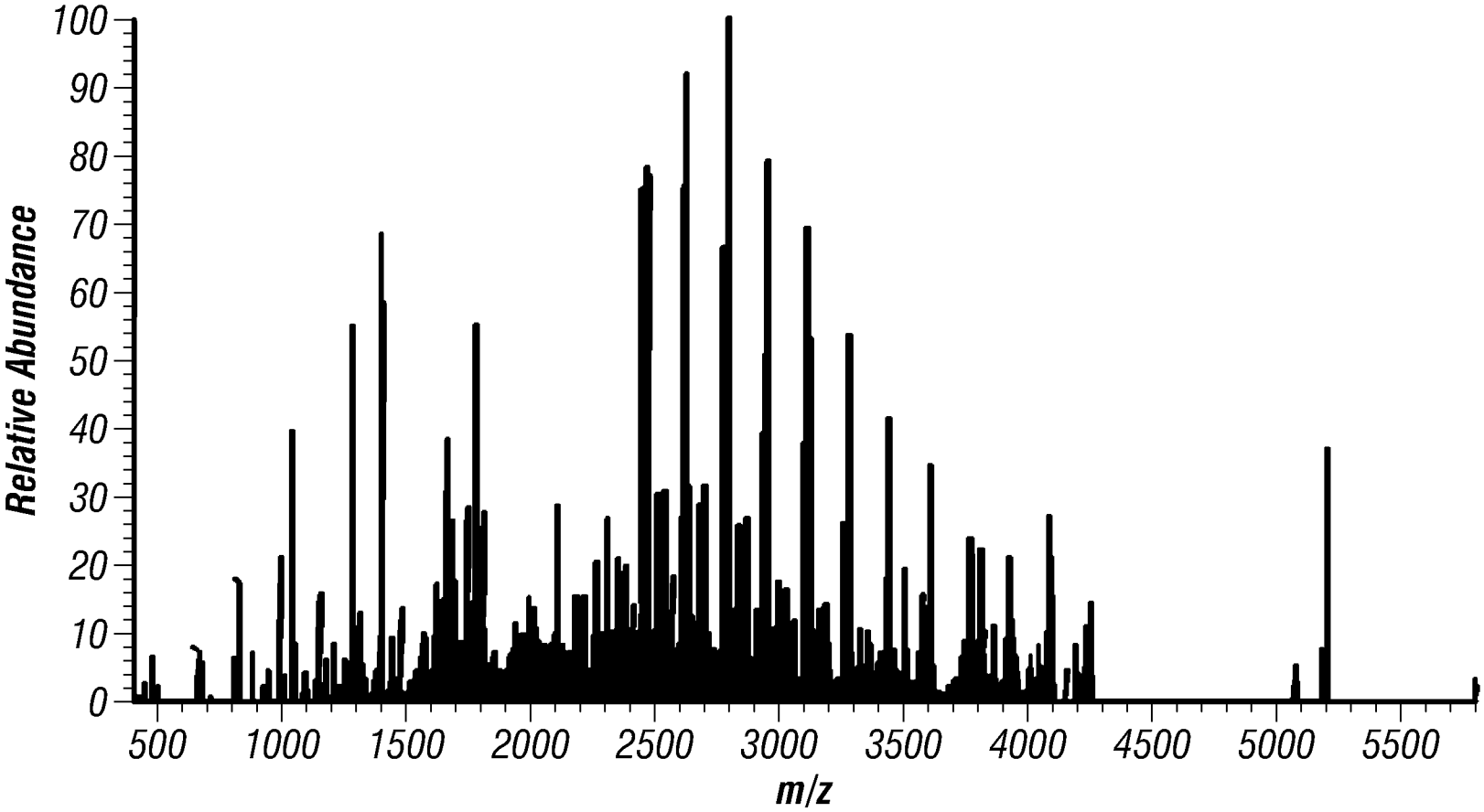
Figure 6B:
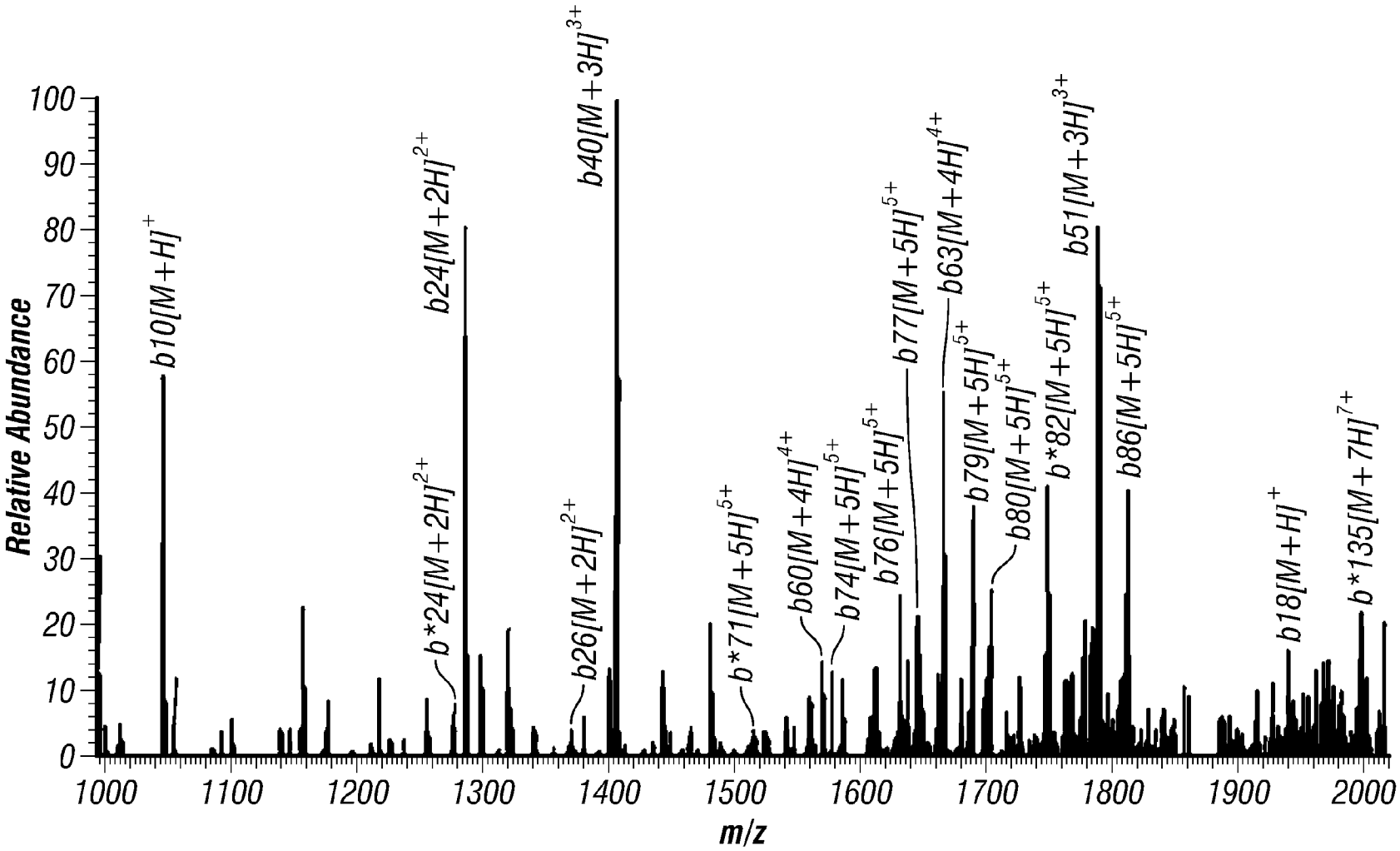
Figure 6C:
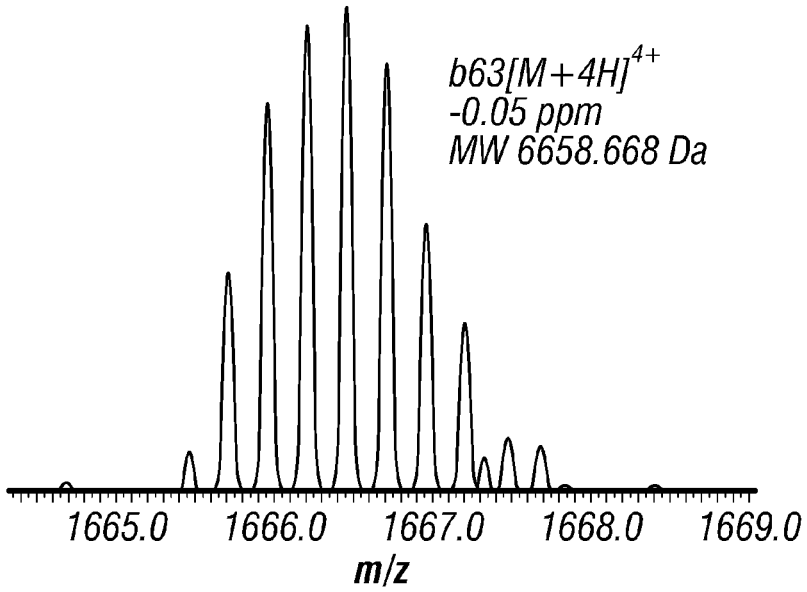

FIGS. 6A-6C show $MS^3$ spectra obtained with the 14-mer GroEL complex. In detail, FIG. 6A shows a complete $MS^3$ spectrum after isolation of 3 most abundant charge states of the GroEL monomer; and FIG. 6B shows a portion of the mass spectrum in FIG. 6A with selected peptide identifications. A total of 97 y- and b-fragments were identified at a root-mean-square (RMS) error of 4.7 ppm. Out of 97 identified backbone fragment 57 were unique resulting in protein sequence coverage of 48%. The high resolution and S/N achieved can be seen from the spectrum in FIG. 6C of one of the peptide identifications from the spectrum FIG. 6B.

Figure 7A:
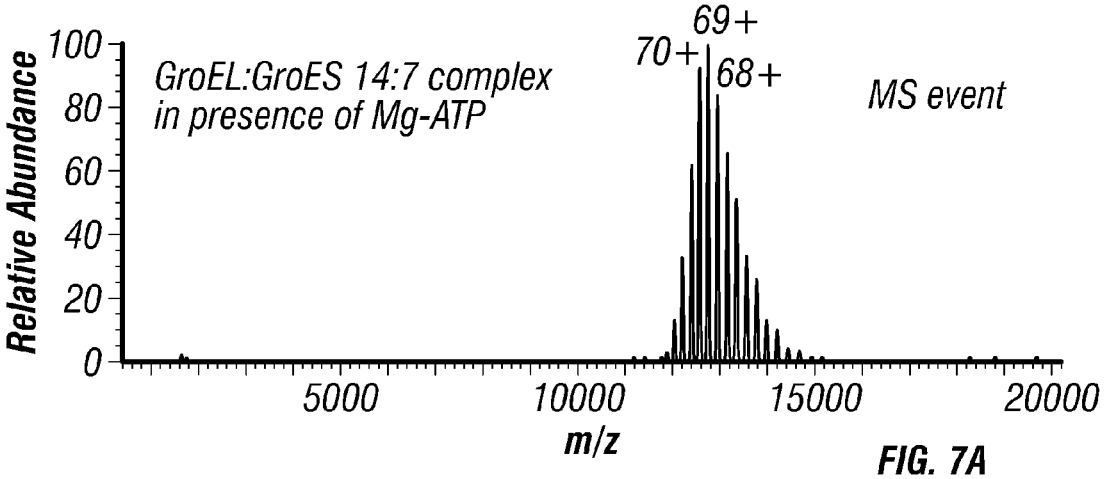
FIGS. 7A-7C show spectra obtained using the invention, wherein spectrum
Figure 7B:
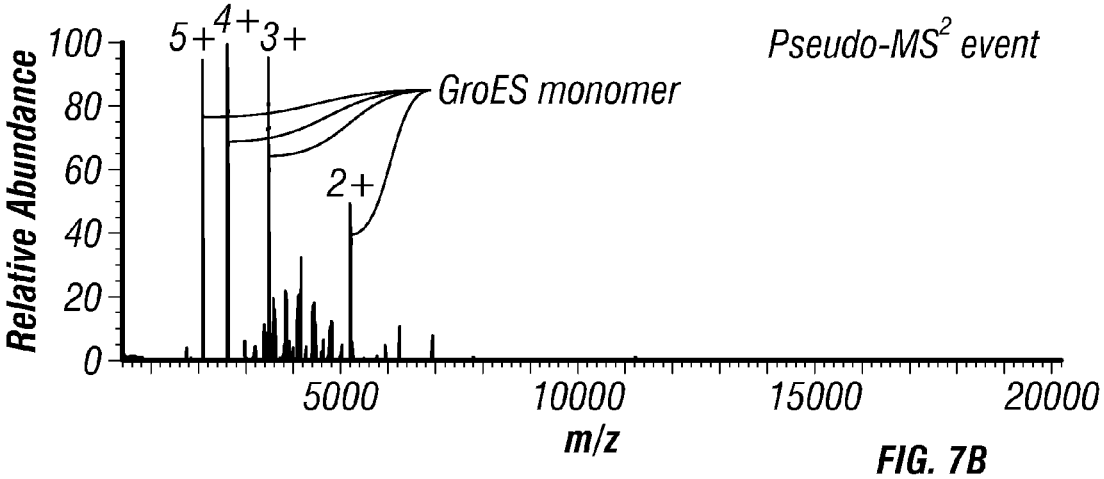
Figure 7C:
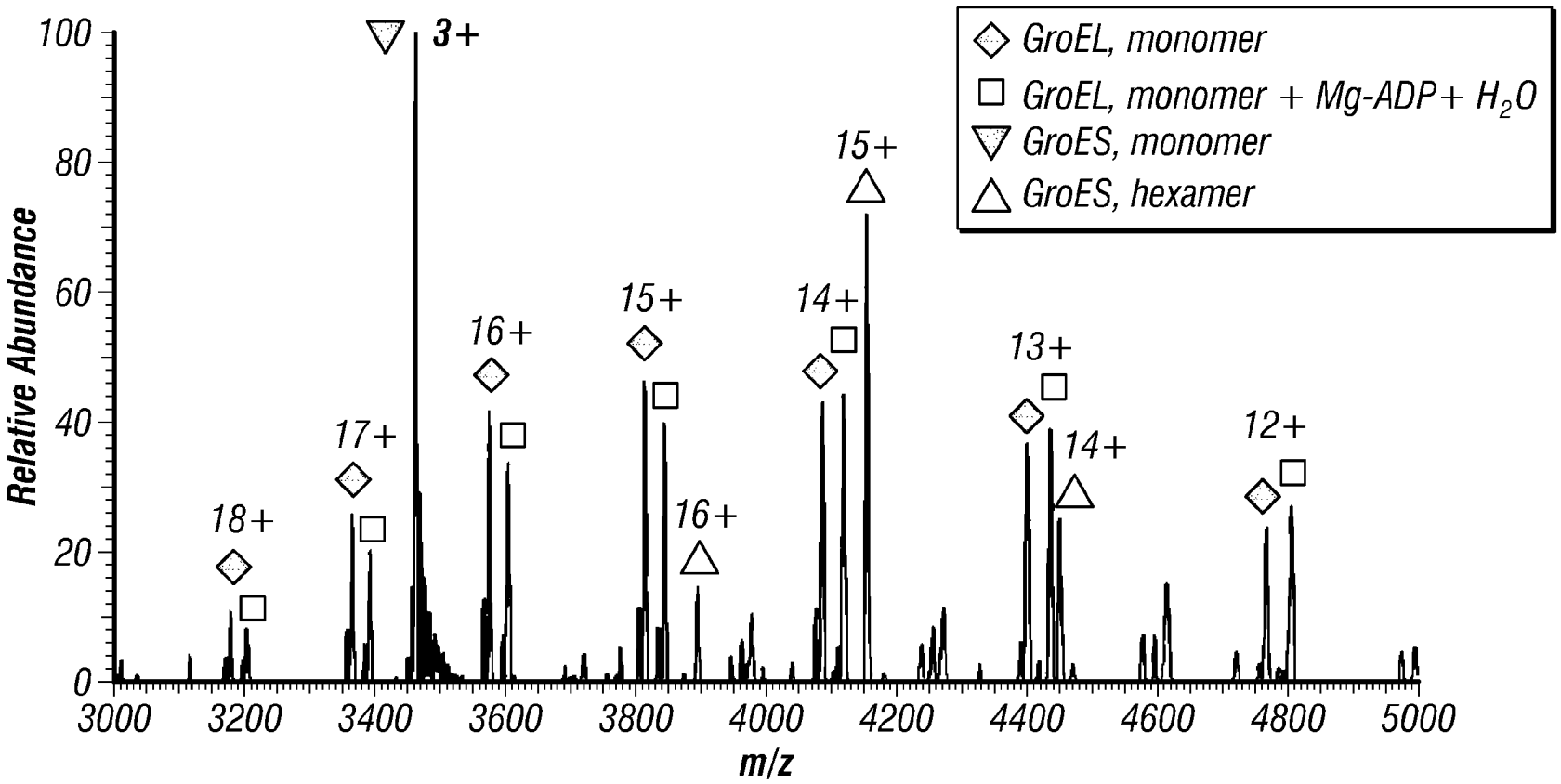
Figure 8A:
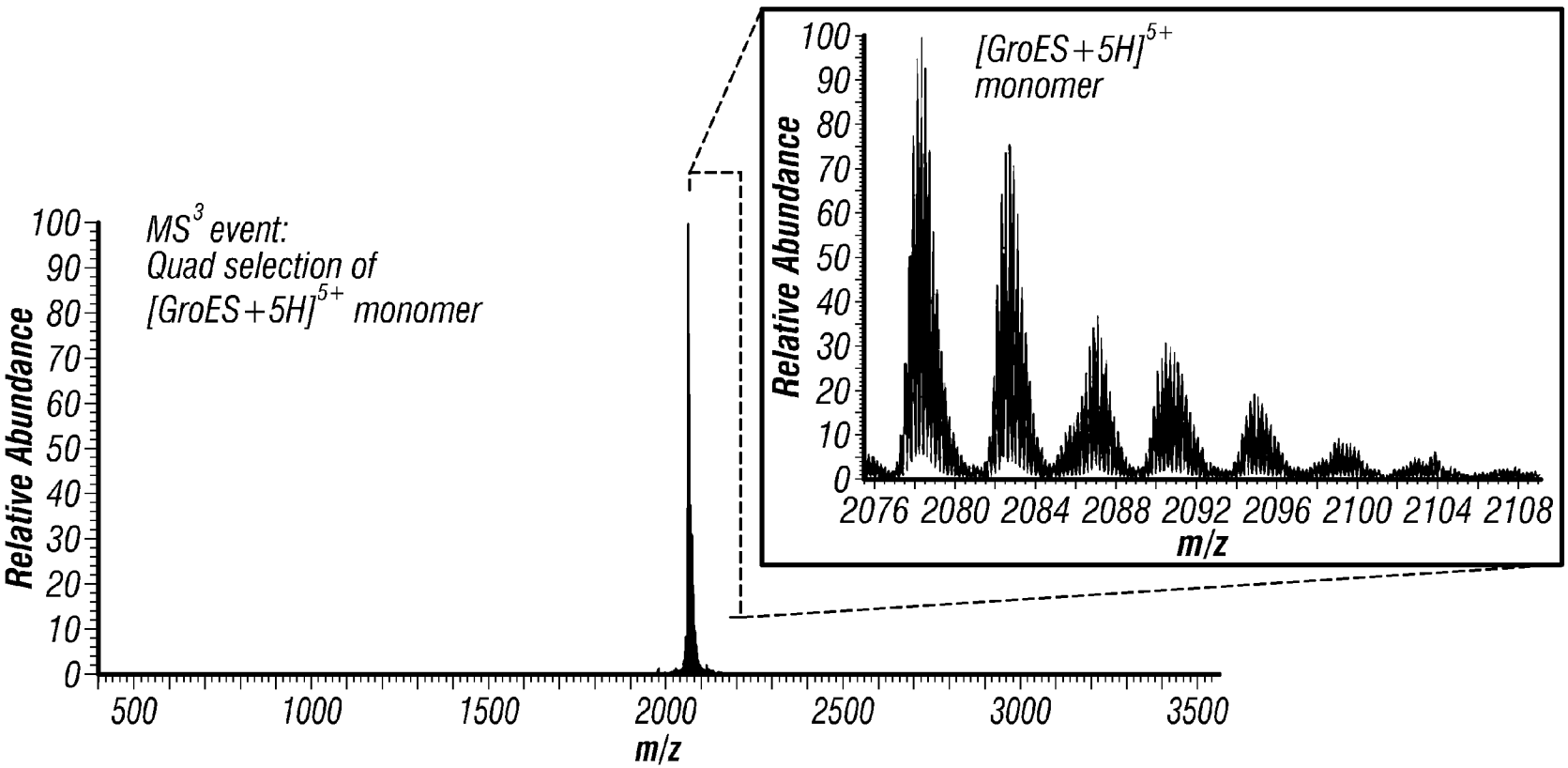
Figure 8B:
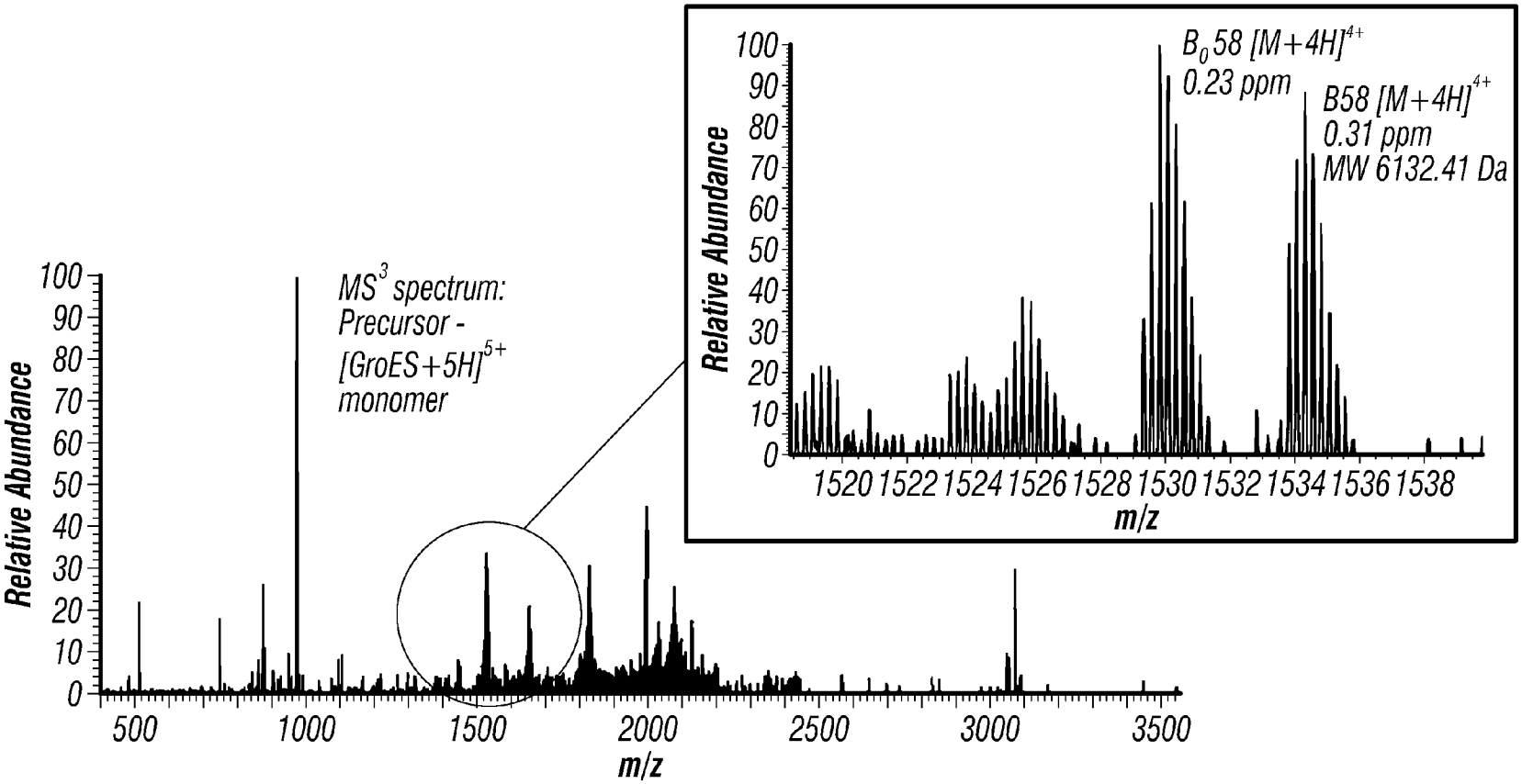
Figure 9A:
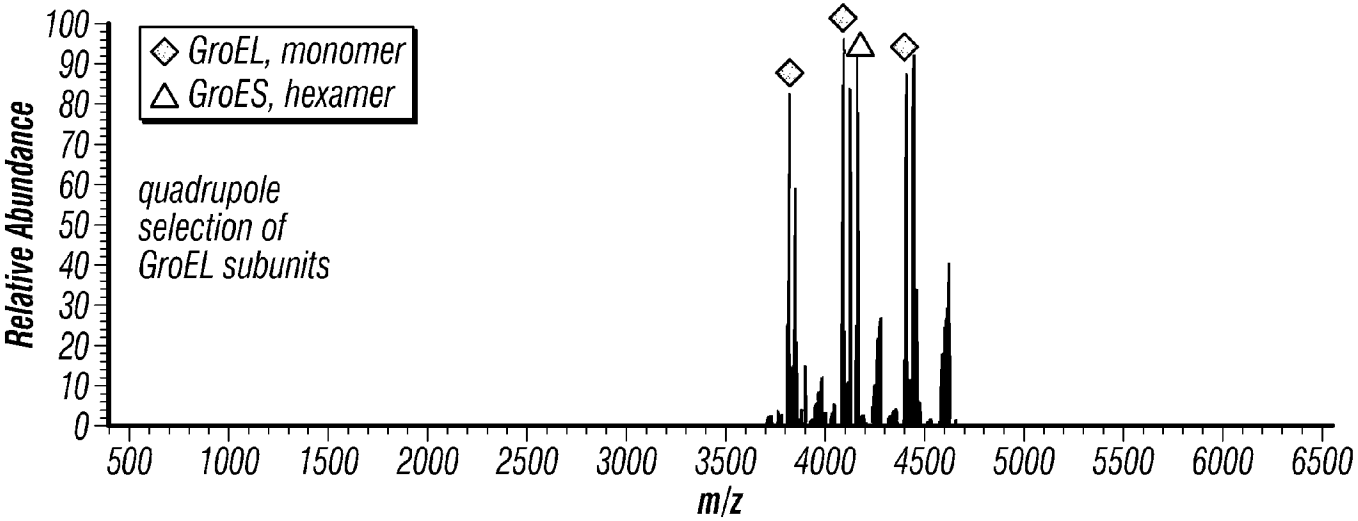
Figure 9B:
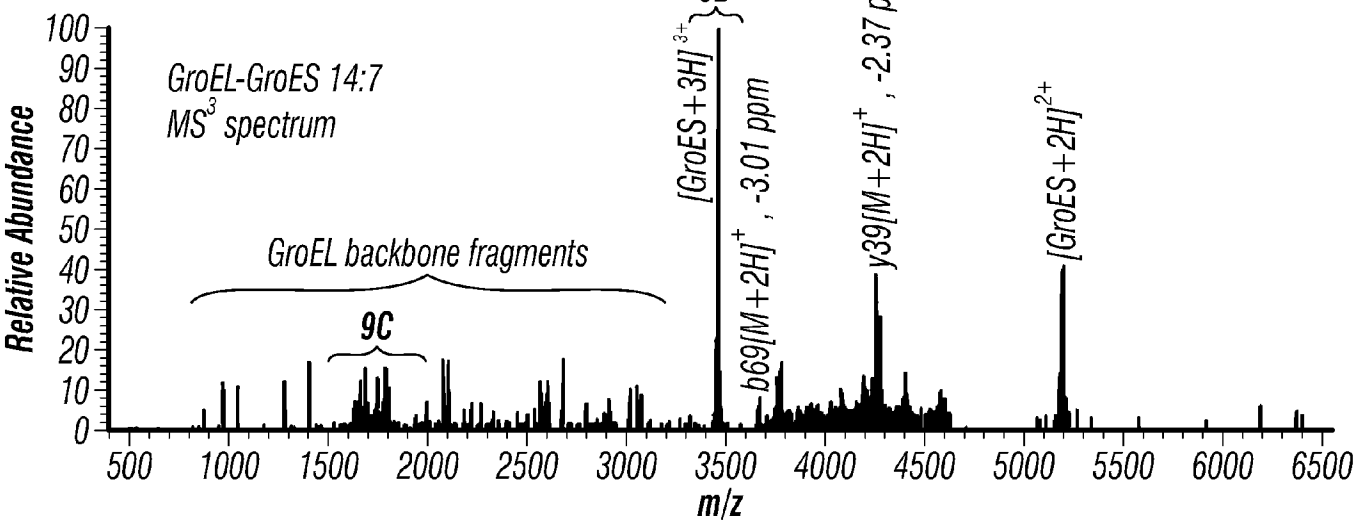
Figure 9C:
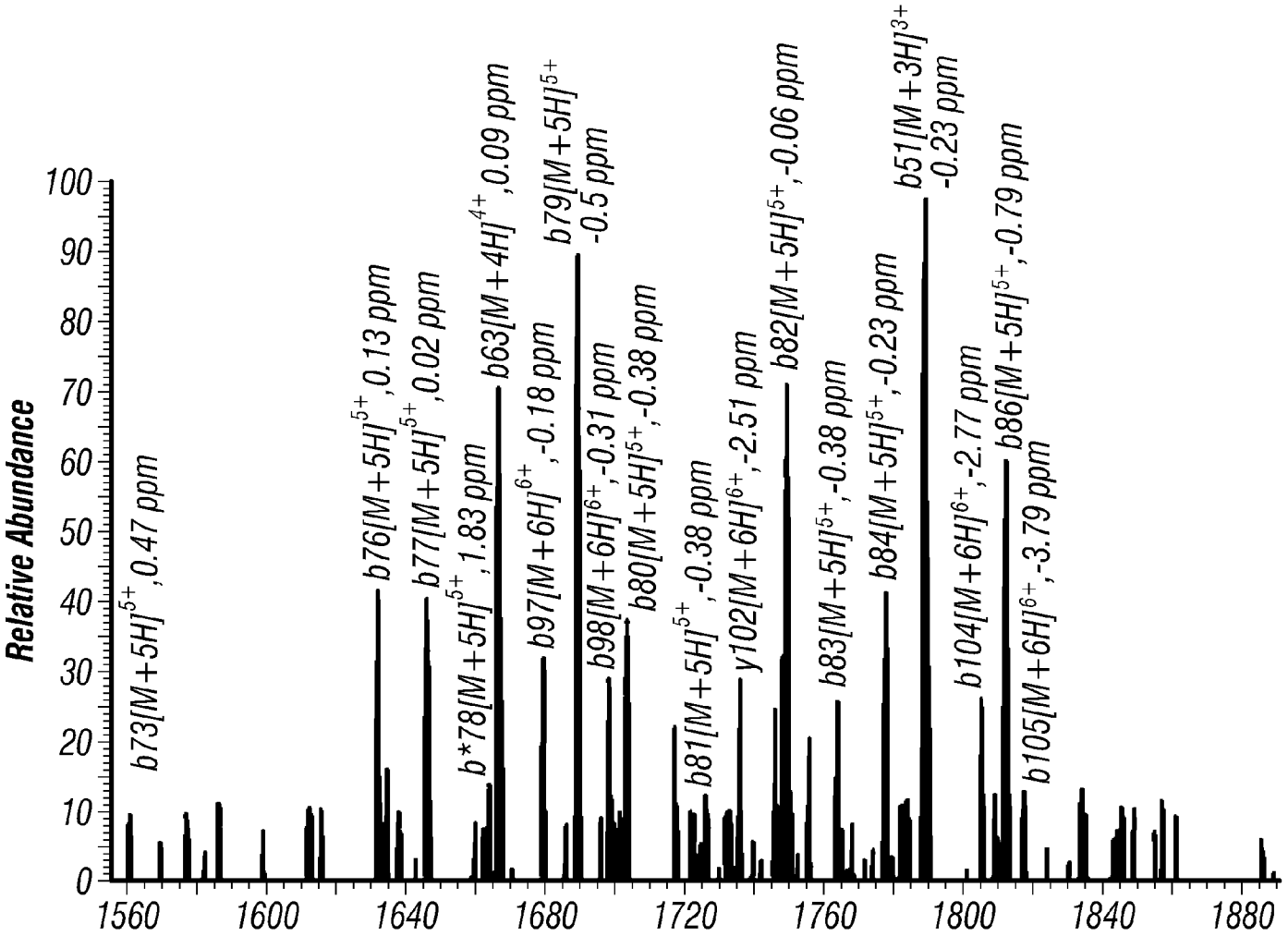
Figure 9D:
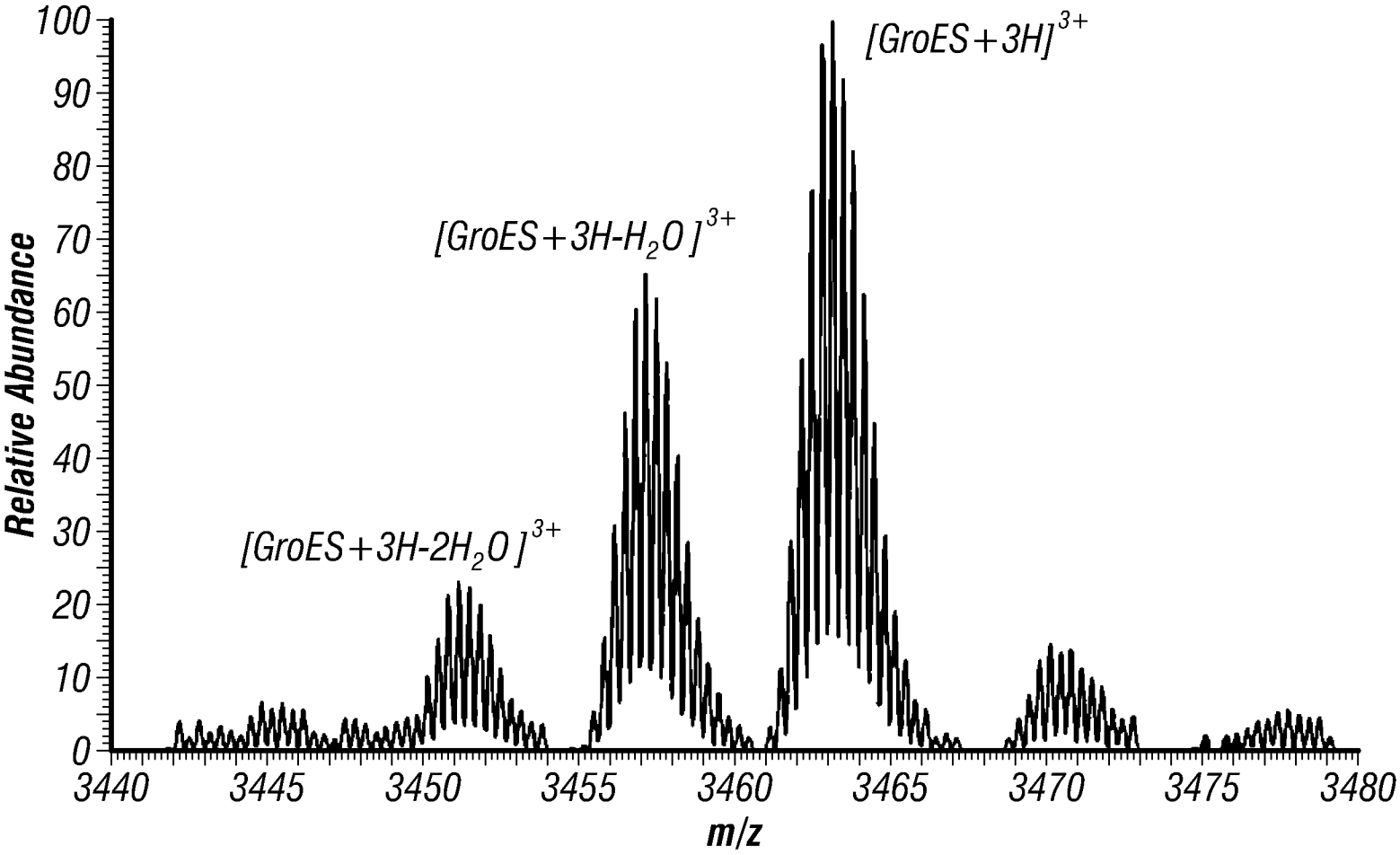

While dissociating GroEL-like large complexes is feasible in the prior art 'fly-through' mode, that approach has been found to be unreliable and incompatible with different sample preparation techniques. In addition, the existing fly-through mode has been found not to work for larger or heteromeric complexes such as GroEL-GroES 14:7, or IgM pentamer complexes. In contrast, the invention has been employed to effectively dissociate GroEL-GroES 14:7 and obtain $MS^2$ and $MS^3$ spectra. Referring to FIG. 7A-7C, in FIG. 7A there is shown a mass spectrum of the intact GroEL-GroES 14:7 complex in the presence of Mg-ATP obtained using the invention; FIG. 7B shows a pseudo $MS^2$ spectrum, revealing dissociation of the 14:7 complex with various charge states of the GroES monomer subunits indicated. In FIG. 7C is shown an expanded view of the FIG. 7B showing peaks of various charge states of GroEL monomer, GroES monomer and GroES hexamer. In FIG. 8A is shown the $MS^2$ spectrum from GroEL-GroES 14:7 complex with selection of the $[GroES+5H]^{5+}$ monomer by the quadrupole mass filter. FIG. 8B shows the $MS^3$ spectrum of fragments from the $[GroES+5H]^{5+}$ precursor. A total of 69 backbone fragments were identified at an RMS error of 3.3 ppm. The number of unique fragments was found to be 35, yielding 100% sequence coverage of the GroES subunit ejected from GroEL-GroES 14:7 heteromeric complex. Selection of GroEL monomer subunits using the quadrupole was also carried out as shown in FIG. 9A, which shows isolation of GroEL monomers and GroES hexamer. In FIG. 9B is shown the $MS^3$ spectrum, with the GroEL backbone fragments indicated (section expanded in FIG. 9C), along with GroES monomers (section expanded in FIG. 9D) and fragments. While tentative identification of the GroES hexamer species is feasible based on coarse charge state deconvolution, direct confirmation of the presence of GroES hexamer in $MS^2$ spectrum of the GroEL-GroES 14:7 heteromeric complex was obtained in the following $MS^3$ experiment. Three different charge states of the GroES monomer subunit and several fragments were derived from a single charge state of the GroES hexamer at a mass accuracy better than 5 ppm. In addition, $MS^3$ fragmentation of GroEL monomer subunits resulted in identification of 49 backbone fragments at an RMS error of 2.3 ppm. The total number of unique GroEL backbone fragments originating from a GroEL subunit, which in turn was ejected from the GroEL-GroES 14:7 complex, was found to be 34, resulting in 34% GroEL subunit sequence coverage. The data acquired show that the invention is capable of providing a reliable fragmentation pathway for sequencing large native protein complexes to backbone fragments, i.e. protein complexes to monomers to backbone fragments.

It has been found that trapping large intact precursor complex ions at high kinetic energy in the elevated pressure region of the front end trap addresses inefficiencies of the prior art approach both in the activation of the large intact precursor complexes and in the collisional relaxation of the ejected monomer subunits. The present invention has been used, for example, to successfully dissociate large heteromeric protein complexes (e.g., GroEL-GroES at MW of 870,300 Da and m/z up to 12,000) and then sequentially select different types of subunits for subsequent fragmentation into constituent peptide-level fragments to sequence and identify the proteins using mass spectrometry at high mass resolution and mass accuracy. Both GroEL and GroES complexes were confidently identified using mass accuracy of 10 ppm or better and mass resolving power of 70,000 or better.

Advantages of the invention lie in the efficient dissociation of large native protein complexes into the constituent monomer subunits ($MS^2$ dissociation) prior to an m/z selection device (e.g. an rf/dc quadrupole). This can be achieved by trapping the precursor ions at higher kinetic energy in an elevated pressure region of ~$10^{-1}$ mbar. Upon dissociation, the ejected monomer subunits are also collisionally relaxed and they can be transferred through the m/z selection device using the optimum settings for higher resolution quadrupole selection. The invention thereby addresses the inefficiency of dissociation of large native protein complexes in the region between the front-end interface and the m/z selection device.

In a preferred embodiment, the invention utilises trapping of larger native protein complexes in a stacked-ring device at elevated pressure prior to the m/z selection device to enable higher kinetic energy activation and axial field-controlled trapping and ejection of ion packets. In addition, the greater charge capacity of the stacked-ring assembly at lower RF potentials is of great benefit for accumulating large number of ions (>10 M elementary charges) in the transitional pressure range (~$10^{-1}$ mbar) without the onset of corona discharge.

In another preferred embodiment, which is preferably employed with the stacked-ring device prior to the m/z selection device, the incorporation of two differentially pumped regions into an HCD cell downstream of the m/z selection device enables the decoupling of trapping, fragmentation and ion transfer events for $MS^3$ dissociation. When dealing with large protein subunits (e.g. GroEL monomer at MW 57,161 Da), the former two events are most efficiently implemented in the higher pressure region (e.g. $10^{-1}$ mbar), while implementing the latter in the lower pressure region (e.g. $10^{-3}$ mbar) enables higher resolution detection irrespective of the precursor ion mass. Similarly to the fragmentation device prior to the m/z selection device described above, a stacked-ring assembly is the most suitable device for use in the higher pressure region of ~$10^{-1}$ mbar due to the high charge capacity of the device (>50 M elementary charges) at higher pressures (>$10^{-1}$ mbar) and reduced requirement for the maximum RF amplitudes (100 $V_{pp}$ at 1 MHz).

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The use of any and all examples, or exemplary language ("for instance", "such as", "for example" and like language) provided herein, is intended merely to better illustrate the invention and does not indicate a limitation on the scope of the invention unless otherwise claimed. No language in the specification should be construed as indicating any non-claimed element as essential to the practice of the invention.

As used herein, including in the claims, unless the context indicates otherwise, singular forms of the terms herein are to be construed as including the plural form and vice versa. For instance, unless the context indicates otherwise, a singular reference herein including in the claims, such as "a" or "an" means "one or more".

Throughout the description and claims of this specification, the words "comprise", "including", "having" and "contain" and variations of the words, for example "comprising" and "comprises" etc, mean "including but not limited to", and are not intended to (and do not) exclude other components.

Any steps described in this specification may be performed in any order or simultaneously unless stated or the context requires otherwise.

All of the features disclosed in this specification may be combined in any combination, except combinations where at least some of such features and/or steps are mutually exclusive. In particular, the preferred features of the invention are applicable to all aspects of the invention and may be used in any combination. Likewise, features described in non-essential combinations may be used separately (not in combination).

The invention claimed is:

1. A method of analyzing macromolecular complex ions by mass spectrometry comprising:

introducing macromolecular complex ions into a first fragmentation device wherein the pressure is above about $10^{-2}$ mbar and trapping the complex ions therein for a trapping period of at least 2 ms, the macromolecular complex ion including a plurality of monomer subunits that are non-covalently bound together in the macromolecular complex ion, wherein the first fragmentation device is configured to provide collisional dissociation of the macromolecular complex ions therein at a collision energy of 200 to 300V per elementary charge of the complex ions;

fragmenting the trapped complex ions in the first fragmentation device to produce monomer subunit ions, wherein the macromolecular complex ions and the monomer subunit ions are confined within the first fragmentation device using an RF waveform with an amplitude of 100 Vpp to 300 Vpp;

introducing one or more of the species of subunit ions into a second fragmentation device, spatially separated downstream from the first fragmentation device;

using an RF power supply to apply two RF voltage waveforms to the plurality of electrodes of the second fragmentation device, such that a first RF waveform is applied to every other electrode and a second RF waveform is applied to the remaining electrodes, where the two RF voltage waveforms are 180 degrees out of phase with each other;

fragmenting the subunit ions in the second fragmentation device to produce a plurality of first fragment ions of the subunit ions; and mass analyzing the first fragment ions in a mass analyzer, or subjecting the first fragment ions to one or more further steps of fragmentation to form further fragment ions and mass analyzing the further fragment ions.

2. A method as claimed in claim 1 wherein the introduced complex ions are protein complex ions, the monomer subunit ions are protein ions and the first fragment species are peptide fragments.

3. A method as claimed in claim 2 wherein the protein complex ions have a mass greater than 0.5 MDa.

4. A method as claimed in claim 1 wherein the first fragmentation device comprises a stacked ring assembly.

5. A method as claimed in claim 1 wherein the pressure in the first fragmentation device is from about $10^{-2}$ mbar to about $10^{-1}$ mbar.

6. A method as claimed in claim 1 wherein the subunit ions undergo collisional dissociation in the second fragmentation device at a collision energy from about 100 to 200 V per elementary charge.

7. A method as claimed in claim 1 wherein the step of selecting one or more subunits by m/z is performed by a mass filter which is located between the spatially separated first and second fragmentation devices.

8. A method as claimed in claim 7 wherein the mass filter is a quadrupole mass filter that operates in an RF only mode with a superimposed auxiliary RF waveform, the auxiliary waveform being applied as dipolar excitation between a pair of opposite rods of the quadrupole and the frequency spectrum of the auxiliary RF waveform is composed of a tailored noise with up to ten different notches, corresponding to the frequencies of secular oscillations of precursor subunit ions in the quadrupole mass analyzer and the width of each notch in the frequency spectrum is in the range of 1 kHz to 5 kHz.

9. A method as claimed in claim 8 wherein multiple precursor ions are concurrently transmitted through the quadrupole mass filter employing the RF waveform.

10. A method as claimed in claim 1 wherein the macromolecular complex ions are introduced as a continuous stream into the first fragmentation device and wherein the trapping period is at least 2 ms; the method further comprising:

ejecting the monomer subunit ions as a packet from the first fragmentation device to the second fragmentation device;

repeating the steps of trapping the complex ions in the first fragmentation device and ejecting the packets of subunit ions from the first fragmentation device so as to accumulate a plurality of packets of subunit ions in the second fragmentation device;

fragmenting the accumulated plurality of packets of subunit ions in the second fragmentation device to produce the first fragment ions of the subunit ions; and mass analyzing the first fragment ions in the mass analyzer, or subjecting the first fragment ions to one or more further steps of fragmentation to form further fragment ions and mass analyzing the further fragment ions.

11. A method as claimed in claim 1 wherein the second fragmentation device is an ion trap.

12. A method as claimed in claim 11 wherein the pressure in the second fragmentation device is from $10^{-4}$ mbar to $10^{-1}$ mbar.

13. A method as claimed in claim 12 wherein the second fragmentation device is separated into differently pumped pressure regions, comprising a higher pressure region above about $10^{-2}$ mbar and a lower pressure region.

14. A method as claimed in claim 13 wherein the higher pressure section is located further from the mass analyzer than the lower pressure section.

15. A method as claimed in claim 14 wherein ions must be passed through the lower pressure section to reach the higher pressure section and must be passed back through the lower pressure section to reach the mass analyzer.

16. A method as claimed in claim 15 wherein the subunit ions are passed through the lower pressure section to the higher pressure section for fragmentation and subsequently fragment ions are accumulated and compressed near the entrance of the lower pressure section prior to passing the ions to the mass analyzer.

17. A method as claimed in claim 13 wherein the higher pressure region of the second fragmentation device comprises a stacked ring assembly.

18. A method as claimed in claim 17 wherein the lower pressure region of the second fragmentation device comprises a multipole.

19. A method as claimed in claim 1 wherein the mass analyzer is an electrostatic trap or time of flight or quadrupole mass analyzer.

20. A method as claimed in claim 1 wherein the method further comprises identifying the monomer subunits of the complex ions from the mass analysis of the fragment ions.

21. A mass spectrometer for mass analyzing macromolecular complex ions comprising:

an ion source for generating macromolecular complex ions;

a first fragmentation device comprising a stacked ring assembly configured to operate with a pressure therein of above about $10^{-2}$ mbar for receiving macromolecular complex ions generated from the ion source and trapping the ions for a trapping period of at least 2 ms and for at least fragmenting the complex ions to monomer subunit ions, the macromolecular complex ion including a plurality of monomer subunits that are non-covalently bound together in the macromolecular complex ion, wherein the first fragmentation device is configured to provide collisional dissociation of the complex ions therein at a collision energy of 200 to 300V per elementary charge of the complex ions, wherein the first fragmentation device is configured to confine the macromolecular complex ions and the monomer subunit ions using an RF waveform with an amplitude of 100 Vpp to 300 Vpp;

a second fragmentation device spatially separated downstream from the first fragmentation device for receiving subunit ions from the first fragmentation device and configured to fragment the subunit ions;

an RF power supply to apply two RF voltage waveforms to the plurality of electrodes of the second fragmentation device, such that a first RF waveform is applied to every other electrode and a second RF waveform is applied to the remaining electrodes, where the two RF voltage waveforms are 180 degrees out of phase with each other; and mass analyzer to receive and mass analyze ions from the first and/or second fragmentation devices.

22. A mass spectrometer as claimed in claim 21 wherein the stacked ring assembly is configured to provide an axial electric field and an RF electric field.

23. A mass spectrometer as claimed in claim 21 wherein the pressure in the second fragmentation device or in at least a part of the second fragmentation device is lower than the pressure in the first fragmentation device.

24. A mass spectrometer as claimed in claim 21 the second fragmentation device is an ion trap comprising two differently pumped sections.

25. A mass spectrometer as claimed in claim 24 wherein the lower pressure section of the second fragmentation device comprises an RF multipole.

26. A mass spectrometer as claimed in claim 21 wherein the spectrometer further comprises an ion funnel arrangement between the ion source and the first fragmentation device with orthogonal ion injection from the ion source into the ion funnel arrangement, wherein the ion source is an electrospray ion source.

27. A mass spectrometer for mass analyzing macromolecular complex ions comprising:

an ion source for generating macromolecular complex ions, the macromolecular complex ion including a plurality of monomer subunits that are non-covalently bound together in the macromolecular complex ion;

a first fragmentation device comprising an ion trap to receive complex ions generated from the ion source, wherein the ion trap is configured to be pumped to a pressure above $10^{-2}$ mbar, to trap the complex ions for a period of at least 2 ms to provide a collision energy from 200 to 300 V per elementary charge of the complex ions for at least fragmenting the complex ions to monomer subunit ions, and to confine the macromolecular complex ion and monomer subunit ions using an RP waveform with an amplitude of 100 Vpp to 300 Vpp;

a second fragmentation device spatially separated downstream from the first fragmentation device for receiving subunit ions from the first fragmentation device and configured to fragment the subunit ions;

an RF power supply to apply two RF voltage waveforms to the plurality of electrodes of the second fragmentation device, such that a first RF waveform is applied to every other electrode and a second RF waveform is applied to the remaining electrodes, where the two RF voltage waveforms are 180 degrees out of phase with each other; and a mass analyzer to receive and mass analyze ions from the first and/or second fragmentation devices.

28. A mass spectrometer as claimed in claim 27 wherein the ion trap is configured to be pumped to a pressure from about $10^{-2}$ mbar to about $10^{-1}$ mbar.

29. A mass spectrometer as claimed in claim 27 wherein the ion trap is configured to provide an axial electric field and an RF electric field.

30. A mass spectrometer as claimed in claim 27 wherein the second fragmentation device is configured to provide a collision energy for ions therein of 100 to 200 V per elementary charge.

* * * * *